US008127943B2

(12) United States Patent
Takashima et al.

(10) Patent No.: US 8,127,943 B2
(45) Date of Patent: Mar. 6, 2012

(54) CIGARETTE DISPLAY SYSTEM

(75) Inventors: Norikazu Takashima, Tokyo (JP); Hiroshi Kawaida, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 324 days.

(21) Appl. No.: 12/443,408

(22) PCT Filed: Sep. 28, 2007

(86) PCT No.: PCT/JP2007/001051

§ 371 (c)(1),
(2), (4) Date: May 18, 2009

(87) PCT Pub. No.: WO2008/041358

PCT Pub. Date: Apr. 10, 2008

(65) Prior Publication Data

US 2010/0025345 A1 Feb. 4, 2010

(30) Foreign Application Priority Data

Sep. 29, 2006 (JP) ..... 2006-266625

(51) Int. Cl.
*A47F 1/04* (2006.01)

(52) U.S. Cl. ..... 211/59.3

(58) Field of Classification Search ..... 211/50, 211/49.1, 59.2, 59.3, 126.1, 189, 134, 13.1, 211/187, 175, 184; 206/526, 817, 739, 774; 108/144.11, 147.11, 51.11; 312/61, 71
See application file for complete search history.

(56) References Cited

U.S. PATENT DOCUMENTS

| | | | | | |
|---|---|---|---|---|---|
| 2,098,844 | A | * | 11/1937 | Waxgiser | 211/59.3 |
| 2,934,212 | A | * | 4/1960 | Jacobson | 211/59.3 |
| 4,923,070 | A | * | 5/1990 | Jackle et al. | 211/59.2 |
| RE33,913 | E | * | 5/1992 | Kral et al. | 211/59.2 |
| 5,181,623 | A | * | 1/1993 | Linden et al. | 211/183 |
| 5,295,592 | A | * | 3/1994 | Thorne | 211/59.2 |
| 5,411,146 | A | * | 5/1995 | Jarecki et al. | 211/59.2 |
| 5,505,315 | A | * | 4/1996 | Carroll | 211/59.2 |
| 5,673,801 | A | * | 10/1997 | Markson | 211/59.3 |
| 5,749,478 | A | * | 5/1998 | Ellis | 211/59.2 |
| 5,788,090 | A | * | 8/1998 | Kajiwara | 211/59.2 |

(Continued)

FOREIGN PATENT DOCUMENTS

JP 2-141259 U 11/1990

(Continued)

*Primary Examiner* — Jennifer E. Novosad
(74) *Attorney, Agent, or Firm* — Birch, Stewart, Kolasch & Birch, LLP

(57) ABSTRACT

A cigarette display system 1000 can link a plurality of frame units 300 in a vertical direction, and each of the frame units 300 can hold a plurality of tray units 200 in an arrangement in which the tray units 200 are separated apart in the vertical direction. Each of the tray units 200 can hold a plurality of magazine units 100 arranged in a lateral direction, and each of the magazine units 100 can hold a plurality of cigarette packs T arranged in a direction from front to back. Because of this, it is possible to freely change a layout in which the cigarette packs T are arranged and displayed in the vertical and lateral directions so that cigarette cartons K or the like having a shape which cannot be accommodated in the magazine unit 100 can be displayed as well. As described above, the present invention provides the cigarette display system 1000 having a structure in which the layout of the cigarette packs T to be displayed or the like can be changed in various forms.

15 Claims, 32 Drawing Sheets

U.S. PATENT DOCUMENTS

| | | | | |
|---|---|---|---|---|
| 5,878,895 | A * | 3/1999 | Springs | 211/59.3 |
| 5,887,732 | A * | 3/1999 | Zimmer et al. | 211/59.2 |
| 5,944,203 | A | 8/1999 | Vlah et al. | |
| 6,659,293 | B1 * | 12/2003 | Smith | 211/59.2 |
| 6,739,461 | B1 * | 5/2004 | Robinson | 211/59.2 |
| 6,901,946 | B2 * | 6/2005 | Frazier | 137/312 |
| 6,932,449 | B2 * | 8/2005 | Collins et al. | 312/405.1 |
| 7,325,697 | B2 * | 2/2008 | Lim et al. | 211/133.1 |
| 2003/0106867 | A1 * | 6/2003 | Caterinacci | 211/40 |
| 2004/0060884 | A1 | 4/2004 | Nook et al. | |
| 2004/0211736 | A1 * | 10/2004 | Mason | 211/59.2 |
| 2004/0256341 | A1 * | 12/2004 | Donnell et al. | 211/187 |
| 2006/0032827 | A1 * | 2/2006 | Phoy | 211/59.2 |
| 2006/0243683 | A1 * | 11/2006 | Onachilla et al. | 211/59.2 |
| 2007/0062891 | A1 * | 3/2007 | Stievenard | 211/59.2 |
| 2008/0078729 | A1 * | 4/2008 | Bazany et al. | 211/59.2 |
| 2008/0164229 | A1 * | 7/2008 | Richter et al. | 211/59.2 |
| 2010/0025345 | A1 * | 2/2010 | Takashima et al. | 211/59.3 |
| 2010/0072150 | A1 * | 3/2010 | Takashima et al. | 211/59.3 |
| 2010/0140197 | A1 * | 6/2010 | Schneider et al. | 211/59.3 |
| 2010/0307992 | A1 * | 12/2010 | Robertson et al. | 211/59.2 |
| 2010/0314342 | A1 * | 12/2010 | Vardaro et al. | 211/59.3 |

FOREIGN PATENT DOCUMENTS

| | | | |
|---|---|---|---|
| JP | 10-151047 | A | 6/1998 |
| JP | 2002-282099 | A | 10/2002 |
| JP | 2005-237566 | A | 9/2005 |
| JP | 2005-334326 | A | 12/2005 |

* cited by examiner (a)

(b)

(a)

(b)

(a)

(b)

CIGARETTE DISPLAY SYSTEM

TECHNICAL FIELD

The present invention relates to a cigarette display system for displaying cigarette packs to be sold, and more particularly the present invention relates to a cigarette display system placed in a convenience store, and the like.

BACKGROUND ART

Cigarette packs are currently displayed and sold in stores such as so-called convenience stores. The "cigarette pack" mentioned here does not mean a cigarette which is actually smoked, but means a rectangular solid package which accommodates a plurality of cigarettes.

The cigarette display system for displaying cigarette packs includes a plurality of magazine units and a system frame, for example. The magazine unit is formed in the shape of a box which is elongated in a direction from front to back and has an opened top, using a colorless, transparent resin, for example.

The magazine unit can then accommodate upright cigarette packs arranged in the direction from front to back, which are provided from above. A slider member is attached to the magazine unit on its bottom surface so as to be slidable in a direction from front to back.

More specifically, at the bottom of the magazine unit, an elongated opening is formed in a direction from front to back. Upward-protruded ribs are formed on both left and right sides of the opening. And, the slider member is attached to the pair of ribs and the opening so as to be slidable in a direction from front to back.

And, a wound plate spring to serve as an urging mechanism is attached at a rear of the slider member. One end of the plate spring is pulled out from the slider member and attached to a front bottom part of the magazine unit.

Accordingly, a slider member, which is slidable in a direction from front to back, is resiliently urged by the plate spring. Therefore, a plurality of cigarette packs accommodated in the magazine unit is pushed to a forefront by the slider member.

The system frame holds a plurality of magazine units arranged in the vertical and lateral directions. The system frame includes a plurality of guide rails and a single main frame. A pair of guide rails holds both sides of the magazine unit. The main frame is formed by, for example, metal bars in a solid shape. The plurality of guide rails is fixed in pairs to key points of the main frame.

In the cigarette display system as mentioned above, for example, 20 magazine units are mounted in the system frame in an array of 4 rows and 5 columns. For example, 10 cigarette packs are accommodated in each of the magazine units.

The cigarette packs are formed in a rectangular solid shape having surfaces of different sizes, and a brand name and the like are printed on its largest surface as its representative surface. In such cigarette display system, since cigarette packs are accommodated in colorless, transparent magazine units while the cigarette packs are in an upright state, the cigarette packs are displayed while their representative surfaces facing the front. Therefore, the cigarette display system can display, for example, 20 types of cigarette packs, while accommodating 10 packs for each type.

When selling a cigarette pack, the cigarette pack is pulled out upward from the forefront part of the magazine unit and remaining cigarette packs accommodated in the magazine unit are pushed to the front by the slider member. Thereby, the magazine unit may keep the state of displaying the cigarette packs at the forefront position, even after one cigarette pack is pulled out.

When replenishing cigarette packs in the cigarette display system, a magazine unit is detached from the system frame. Cigarette packs are accommodated in the magazine unit, and the magazine unit having the cigarette packs accommodated therein is mounted in the system frame. Therefore, it is not necessary to perform a troublesome operation for replenishing cigarette packs in a magazine unit fixed in the system frame.

In a cigarette display system as mentioned above, it is possible to wash and clean a magazine unit, by detaching the magazine unit from the system frame, for example.

[Patent Document 1]

Japanese Laid-open patent publication NO. 10-151047

DISCLOSURE OF THE INVENTION

Problems To Be Solved By the Invention

As described above, cigarette packs are required to be displayed with their representative surfaces facing the front. When the cigarette packs are arranged in the vertical and lateral directions with their representative surfaces facing the front, it is preferred that their front surface planes are lined up in well-positioned.

In order to realize this arrangement, the conventional cigarette display systems are fixed in the overall shape. For this reason, if the space for installing the system is small, the cigarette display system may not be installable. On the other hand, if the space for installing the system is large, a dead space may be created.

In short, the conventional cigarette display system cannot flexibly adapt to various types of installation space. Thereby, it is not possible to set up an effective sales space while optimizing a store space.

Therefore, conventional stores could not display cigarette packs in various ways. Thereby, stores have not set up a highly-appealing sales space by strategically designing modes of displaying cigarette packs, and companies which provide cigarette packs to stores have been unable to propose various modes of display.

Furthermore, the conventional cigarette display systems have been enlarged in order to display a sufficient quantity of cigarette packs. Therefore, the conventional cigarette display systems are generally heavy. It is therefore not easy to bring in and install the system in a store.

For example, many convenience stores operate 24 hours a day. The cigarette display system therefore needs to be brought in and installed while the store is opened. In other words, the cigarette display system needs to be brought in and installed quickly in a space-saving manner. However, this is difficult so far as the conventional cigarette display systems are used.

Further, conventionally, for example, advertisement units are attached to the cigarette display system to display cigarette packs to customers in an appealing manner. In other words, conventionally, advertisement units are required to display the cigarette packs in a more appealing manner.

As mentioned in the above, it is difficult to readily and quickly bring in and install the conventional cigarette display systems, and there is no flexibility with regards to installation and the modes of display of the cigarette packs. Therefore, it is impossible to set up a highly-appealing space of sales so far as the conventional cigarette display systems are used.

The present invention was accomplished considering the above problems, and provides a cigarette display system allowed for various modifications in the overall shape or in the layout of cigarette packs to be displayed.

Means For Solving the Problems

According to the present invention, there is provided a cigarette display system for displaying cigarette packs to be sold, the system including: a plurality of magazine units formed in the shape of a box which is elongated in the direction from front to back and having an opened top, the magazine units having a shape which allows a plurality of cigarette packs to be held therein while being arranged in the direction from front to back; a plurality of tray units formed in the shape of a box having an opened top, the tray units having a shape which allows a plurality of magazine units arranged in the lateral direction to be held detachably; a plurality of frame units formed in the shape of a box having an opened front, the frame units having a shape which allows a plurality of tray units to be held detachably while arranging the tray units vertically apart from each other; and a frame link mechanism for linking a plurality of frame units in the vertical direction.

Therefore, in the cigarette display system of the present invention, a plurality of frame units can be linked in the vertical direction by the frame link mechanism, and a plurality of tray units can be held by each of the frame units in an arrangement in which the tray units are vertically separated. Each of the tray units can hold a plurality of magazine units arranged in the lateral direction, and each of the magazine units can hold a plurality of cigarette packs arranged in a direction from front to back. Therefore, it is possible to display a plurality of types of cigarette packs by arranging cigarette packs in a direction from front to back for each of the types, then arrange such arranged cigarette packs in the vertical and lateral directions. In this case, the number and arrangement of the magazine units held by the tray unit, the number and arrangement of the tray units held by the frame units, the number of the frame units linked in the vertical direction, the number of the frame units arranged in the lateral direction can be freely changed. Therefore, a layout in which cigarette packs are arranged and displayed in the vertical and lateral directions can be freely changed. Especially, the magazine units are mounted in the frame units by using the tray unit. Therefore, even if a plurality of types of magazine units and tray units which have the plurality of types of different lengths from front to back are prepared, for example, positions of the front surfaces of the magazine units which are arranged in the vertical and lateral directions by the frame units and the tray units can be lined up in well-positioned.

Although the present invention defines a direction from front to back and a lateral direction in addition to a vertical direction, these are definitions of convenience to simply explain relative relationships between components of the present invention, and do not limit the directions upon producing or using the cigarette display system in the practice of the present invention.

Further, the components of the present invention are not necessarily independent entities. It is possible that a plurality of components may be formed as a single member, a single component may be formed as a plurality of members, a component may be a part of another component, and a part of a component may overlap a part of another component.

Effects of the Invention

In the cigarette display system of the present invention, the number and arrangement of the magazine units held by the tray unit, the number and arrangement of the tray units held by the frame units, the number of the frame units linked in the vertical direction, and the number of the frame units arranged in the lateral direction may be changed freely. Therefore the cigarette display system may easily and quickly be brought in and installed in a store. In addition, since there is flexibility in the site of installation and the mode of display of the cigarette packs, it is possible to set up a highly-appealing space. Especially, even if a plurality of types of magazine units and tray units which have the plurality of types of different lengths from front to back are prepared, positions of the front surfaces of the magazine units which are arranged in the vertical and lateral directions by the frame units and the tray units can be lined up in well-positioned. Thus, the cigarette packs can be attractively displayed.

BRIEF DESCRIPTION OF THE DRAWINGS

The objects mentioned above, and other objects, characteristics, and advantages are further revealed by a preferred embodiment to be mentioned below, and the following accompanying drawings thereof.

BEST MODE FOR CARRYING OUT THE INVENTION

Figure 1:
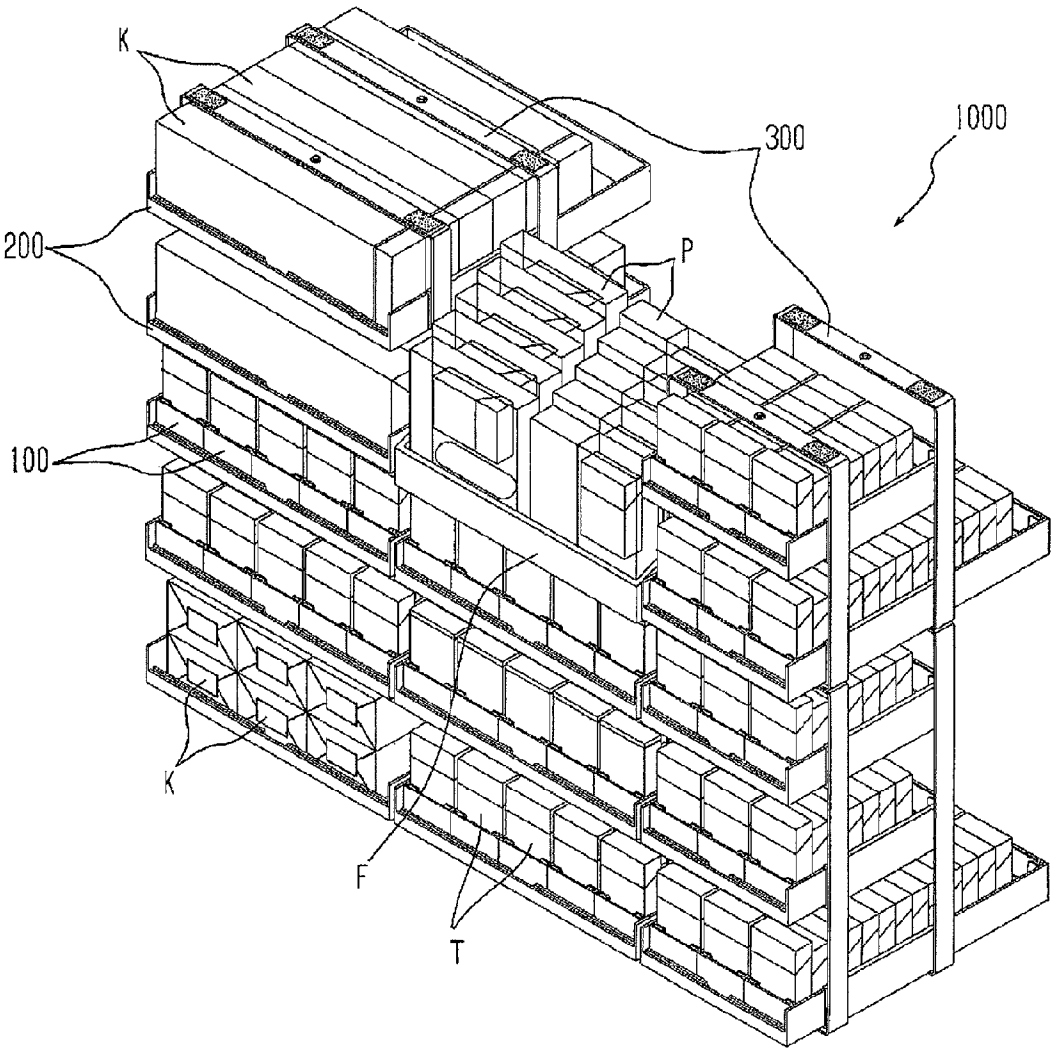
FIG. 1 is a perspective view showing an appearance of a cigarette display system of an embodiment of the present invention.

An embodiment of the present invention will be described with reference to the drawings. As shown in FIG. 1, a cigarette display system 1000 of the embodiment is used to display cigarette packs T to be sold.

Accordingly, as shown in FIG. 1 and the individual figures, the cigarette display system 1000 includes: a plurality of magazine units 100 formed in the shape of a box which is elongated in the direction from front to back and having an opened top, the magazine units 100 having a shape which allows a plurality of cigarette packs T to be held therein while being arranged in the direction from front to back; a plurality of tray units 200 formed in the shape of a box having an opened top, the tray units 200 having a shape which allows a plurality of magazine units 100 arranged in the lateral direction to be held detachably; a plurality of frame units 300 formed in the shape of a box having an opened front, the frame units 300 having a shape which allows a plurality of tray units 200 to be held detachably while arranging the tray units 200 vertically apart from each other; and a frame link mechanism for linking a plurality of frame units 300 in the vertical direction.

More specifically, the cigarette display system 1000 displays the cigarette packs T, cigarette cartons K in each of which a plurality of cigarette packs T are packed, campaign packs P in each of which a cigarette pack T and a free gift are packed together, and the like. The campaign packs P are provided to a store with simple fittings F formed by cardboard, for example.

At present, the cigarette packs T are formed in a rectangular solid shape, which generally has a common length from front to back and lateral width, whilst heights are not uniform. In the embodiment, it is defined that largest surfaces of the cigarette pack T are a front surface and a back surface, and smallest surfaces are a top surface and a bottom surface.

Figure 2:
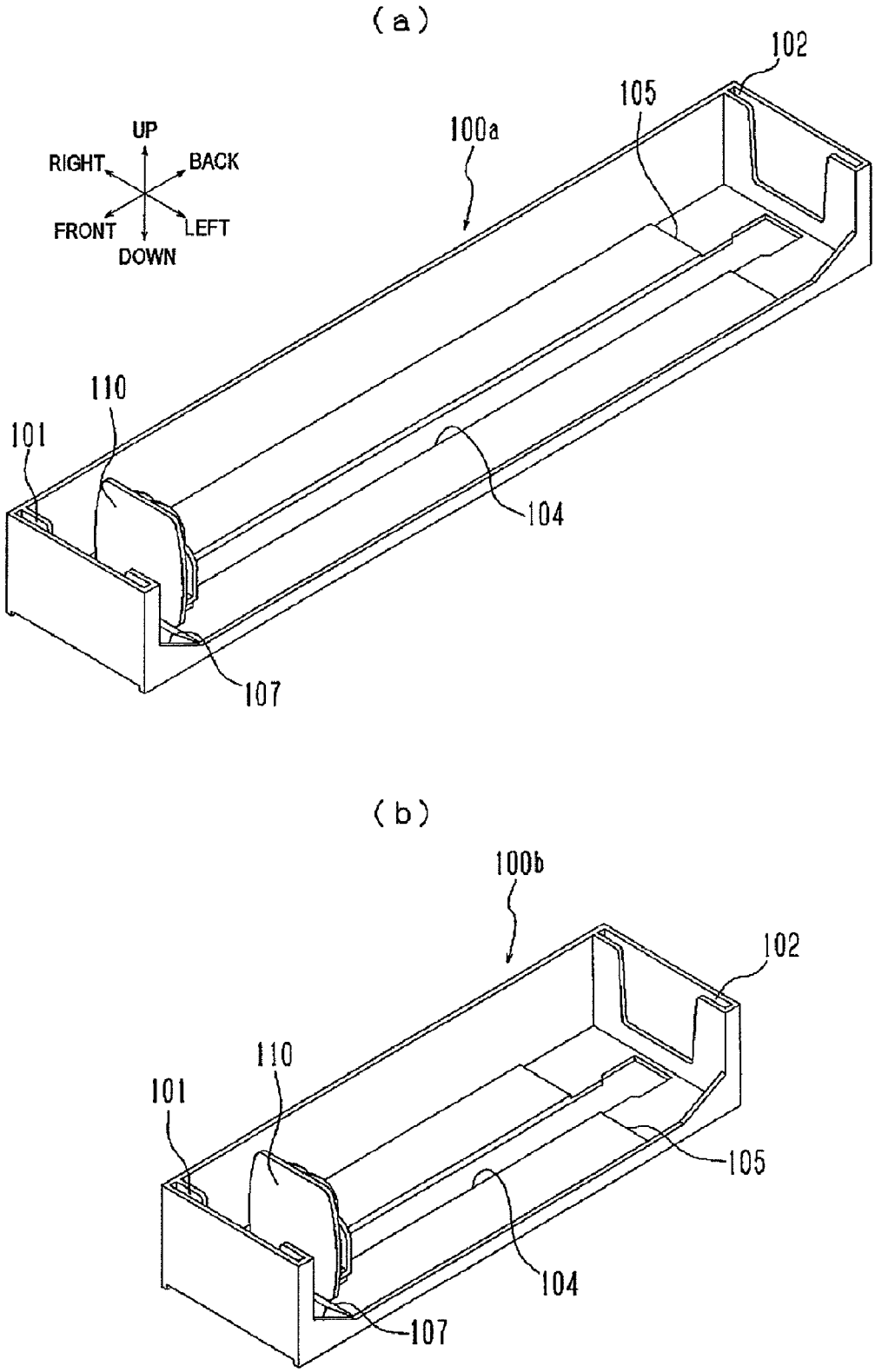
FIG. 2 is a perspective view showing appearances of two types of magazine units.
Figure 3:
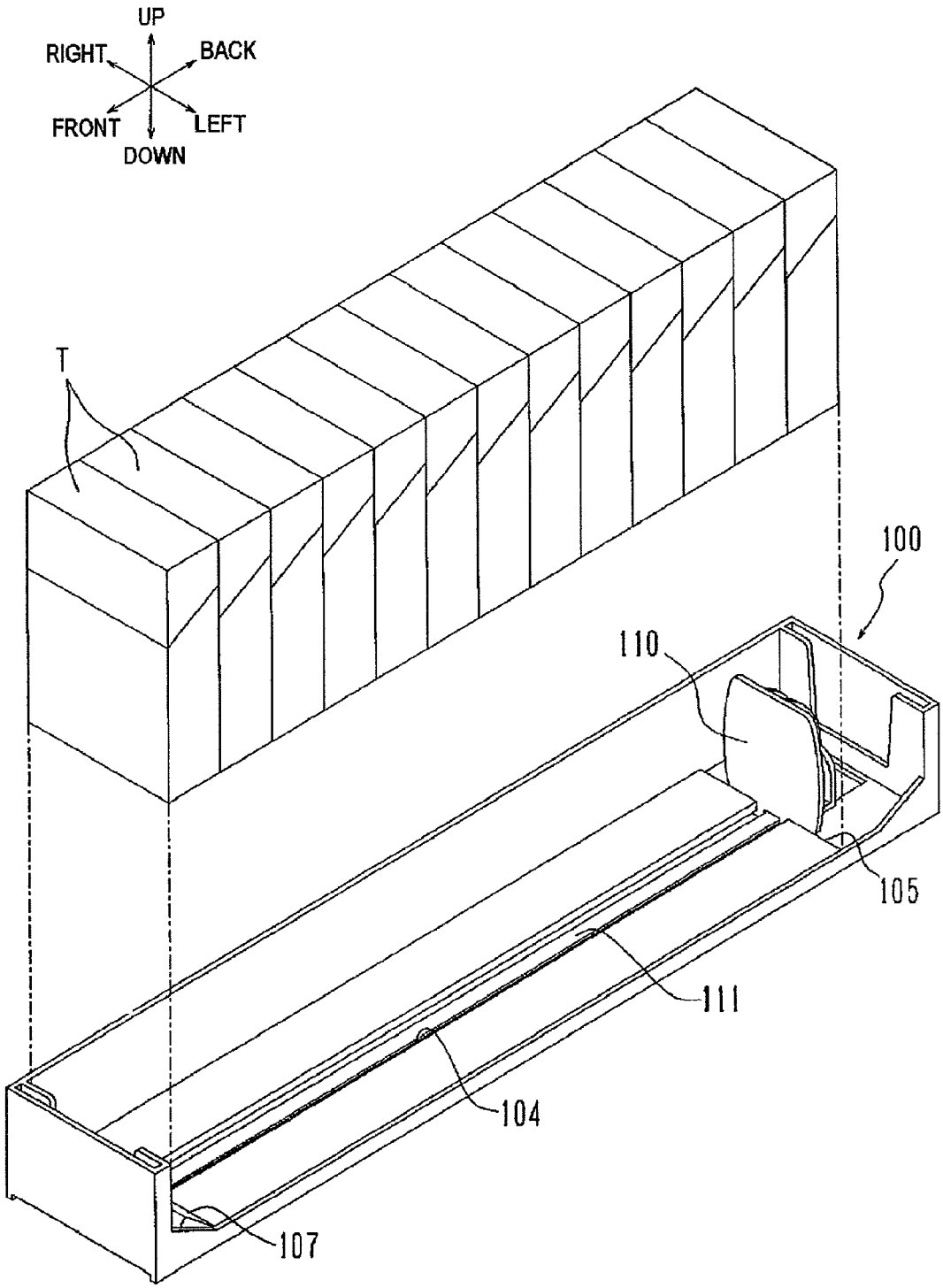
FIG. 3 is an exploded perspective view showing a condition in which cigarette packs are being accommodated in a magazine unit.
Figure 4:
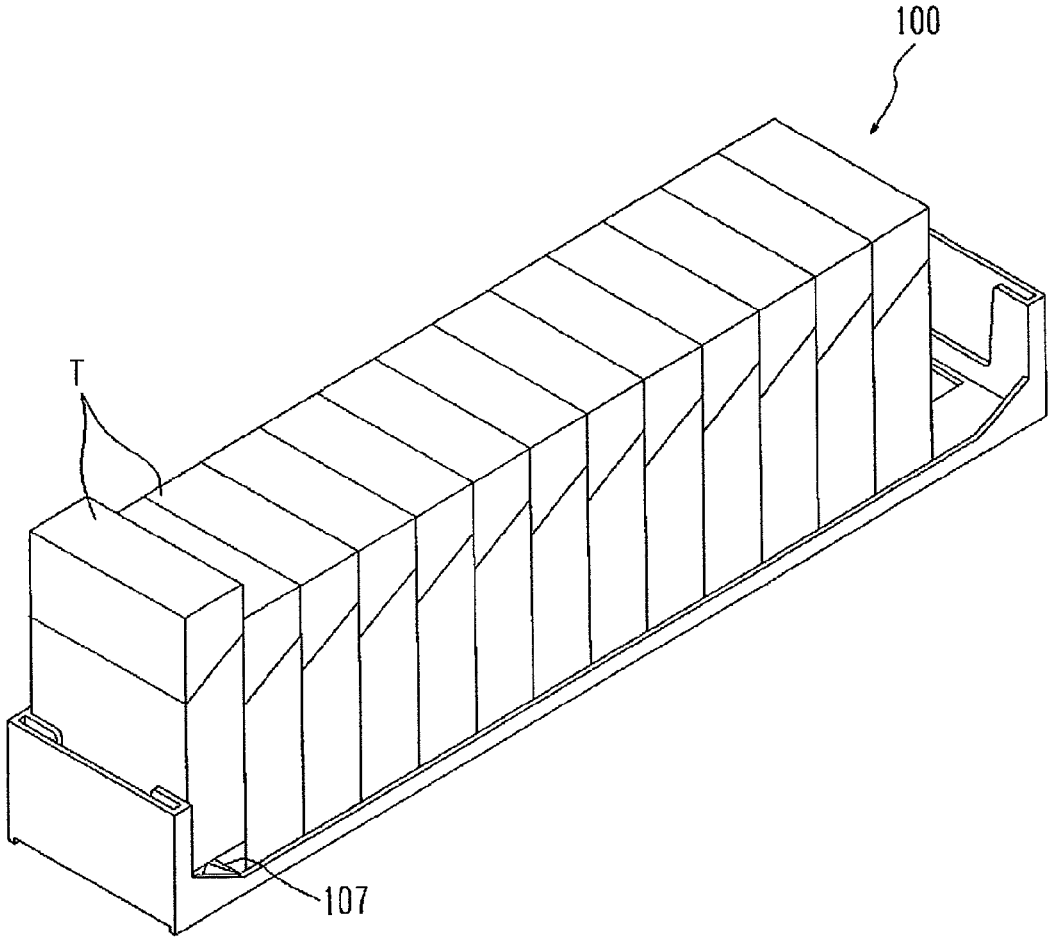
FIG. 4 is a perspective view showing a condition in which cigarette packs have been accommodated in the magazine unit.
Figure 5:
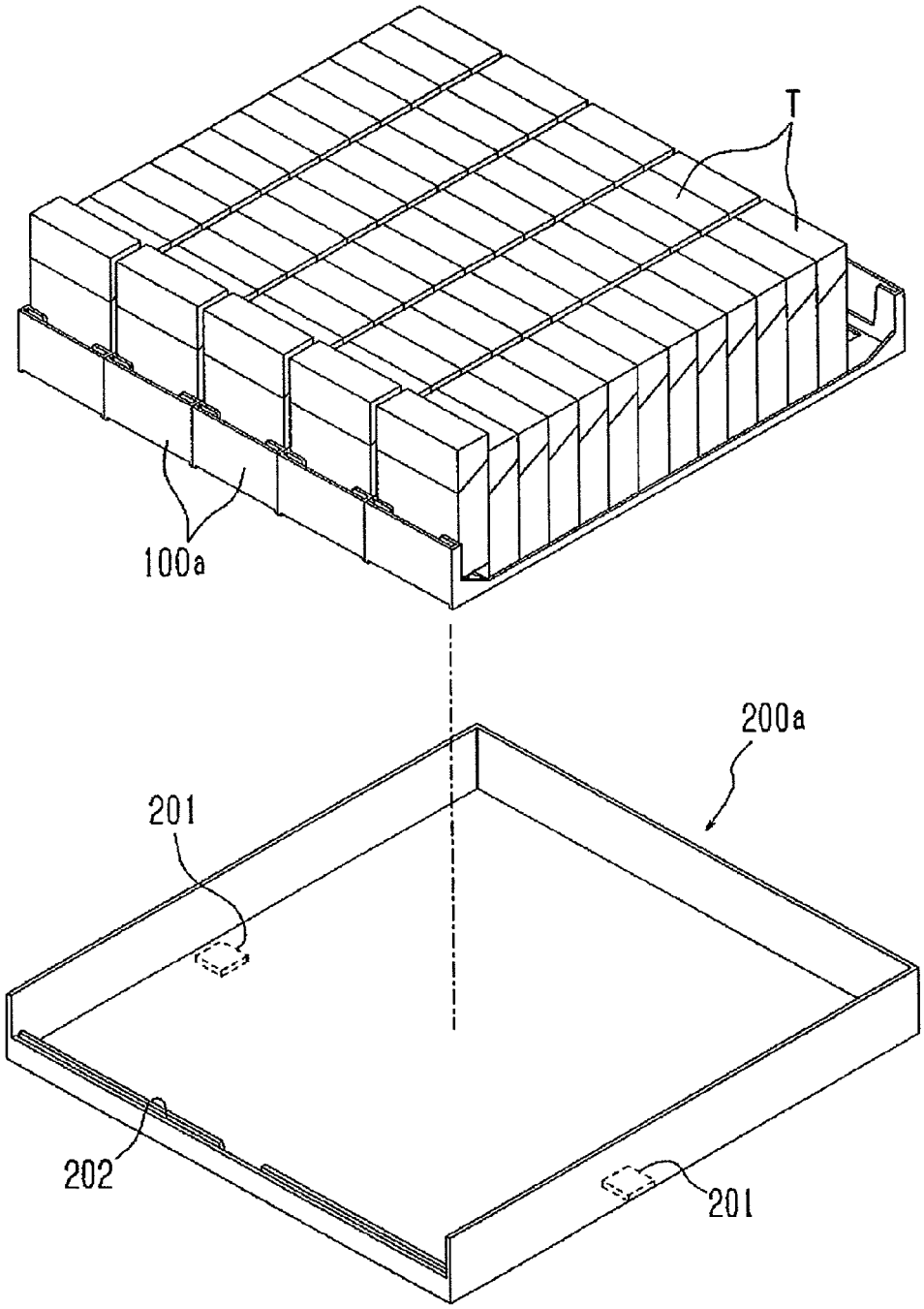
FIG. 5 is an exploded perspective view showing a condition in which the magazine units where the cigarette packs are accommodated are being set into one of four types of tray units.
Figure 6:
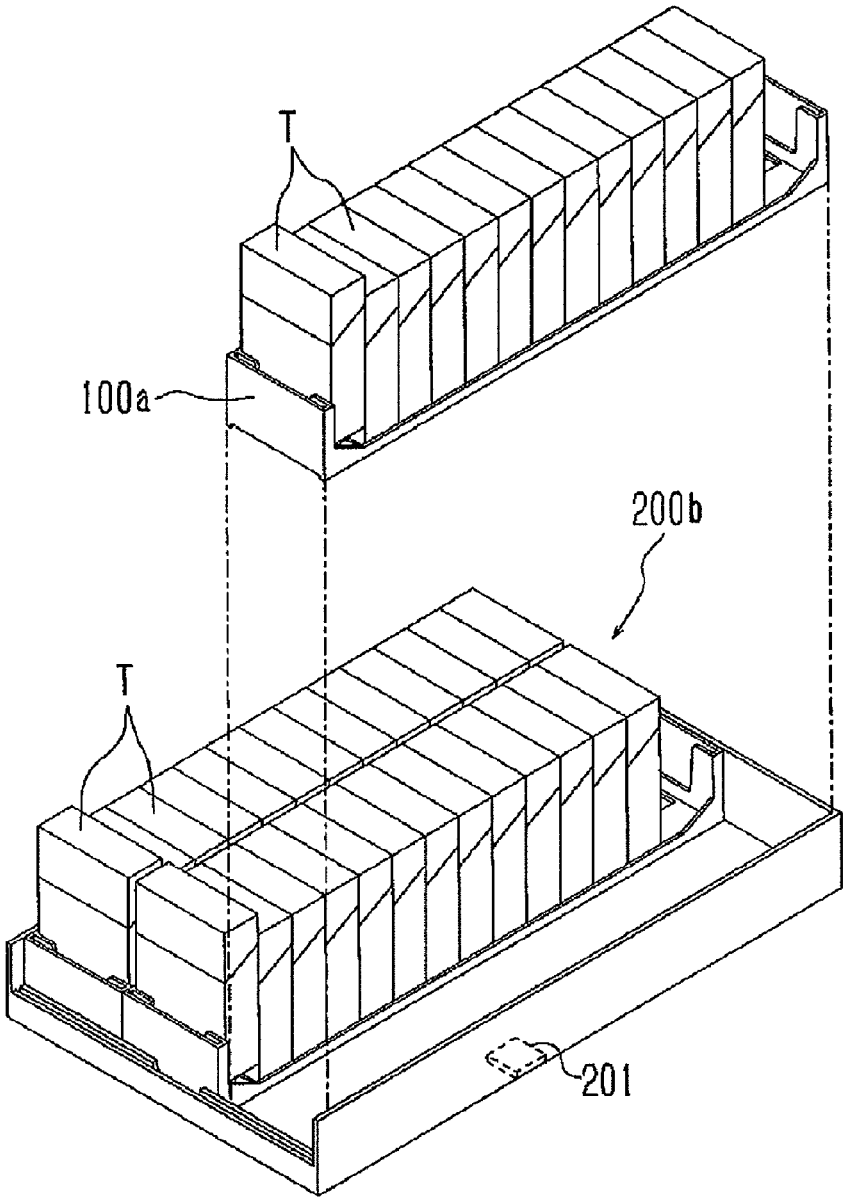
FIG. 6 is an exploded perspective view showing a condition in which the magazine units where the cigarette packs are accommodated are being set into one of four types of tray units.
Figure 7:
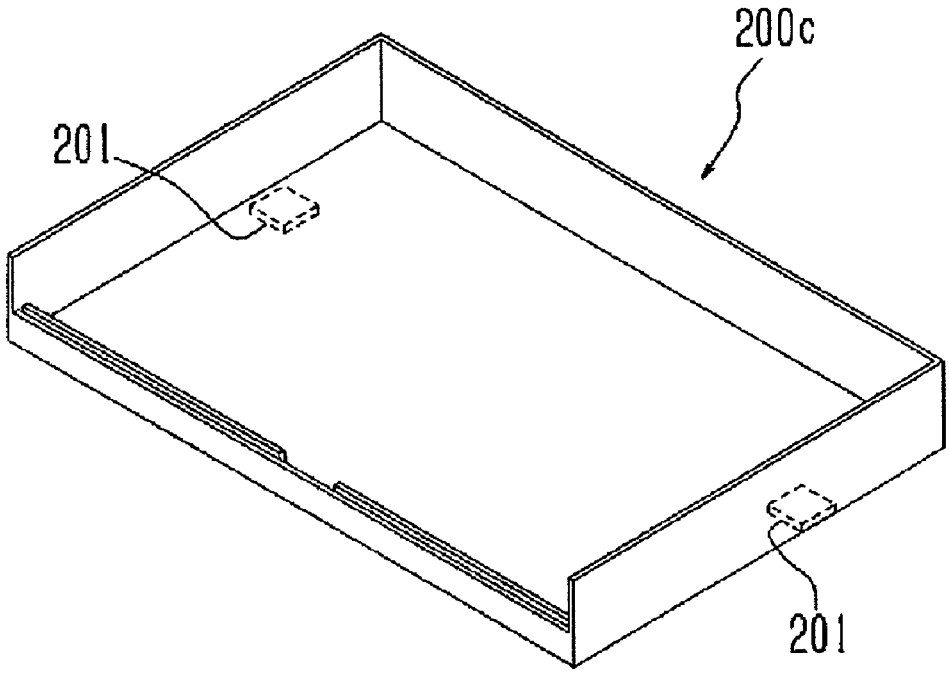
FIG. 7 is a perspective view showing one of the four types of tray units.
Figure 8:
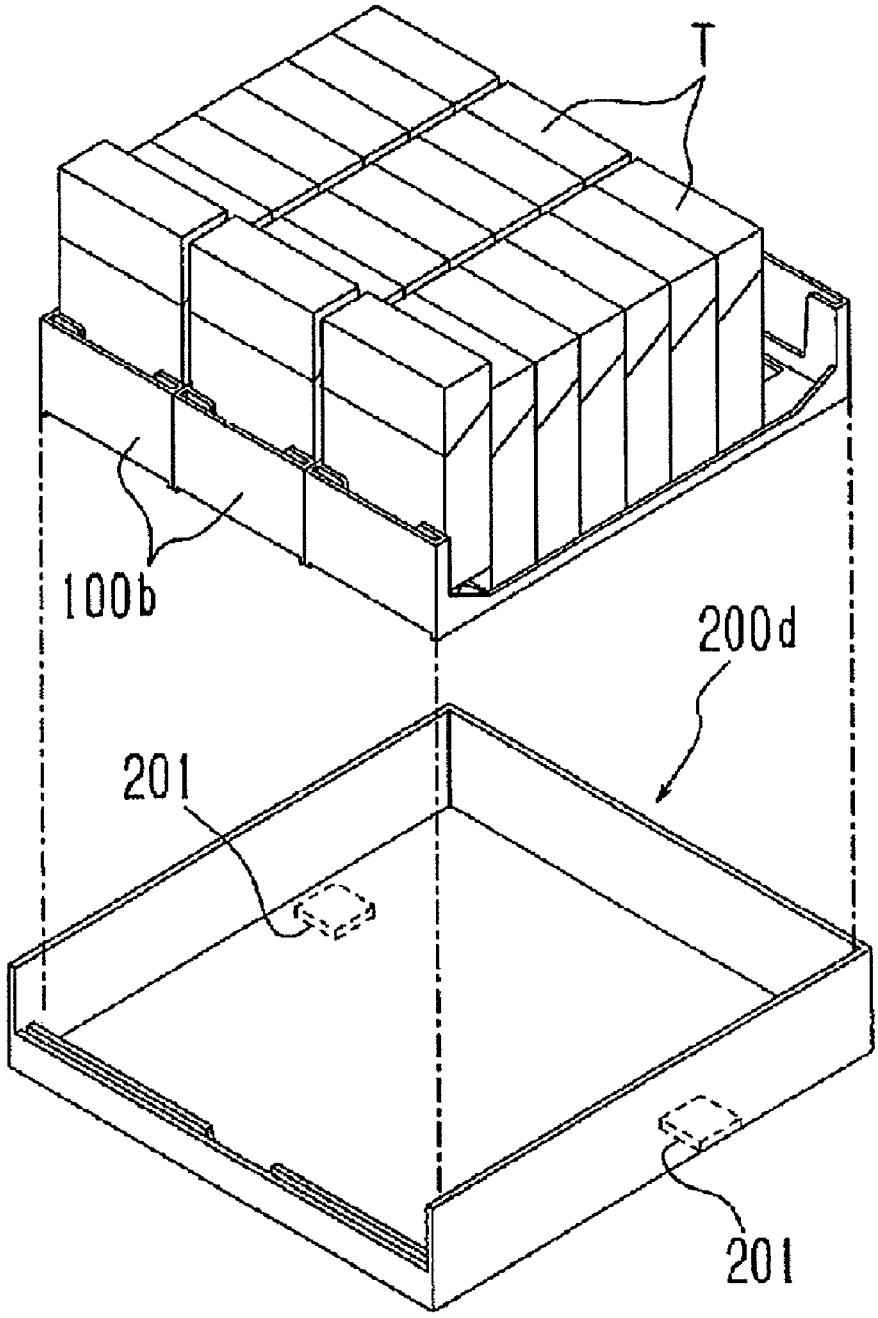
FIG. 8 is an exploded perspective view showing a condition in which the magazine units where the cigarette packs are accommodated are being set into one of four types of tray units.
Figure 9:
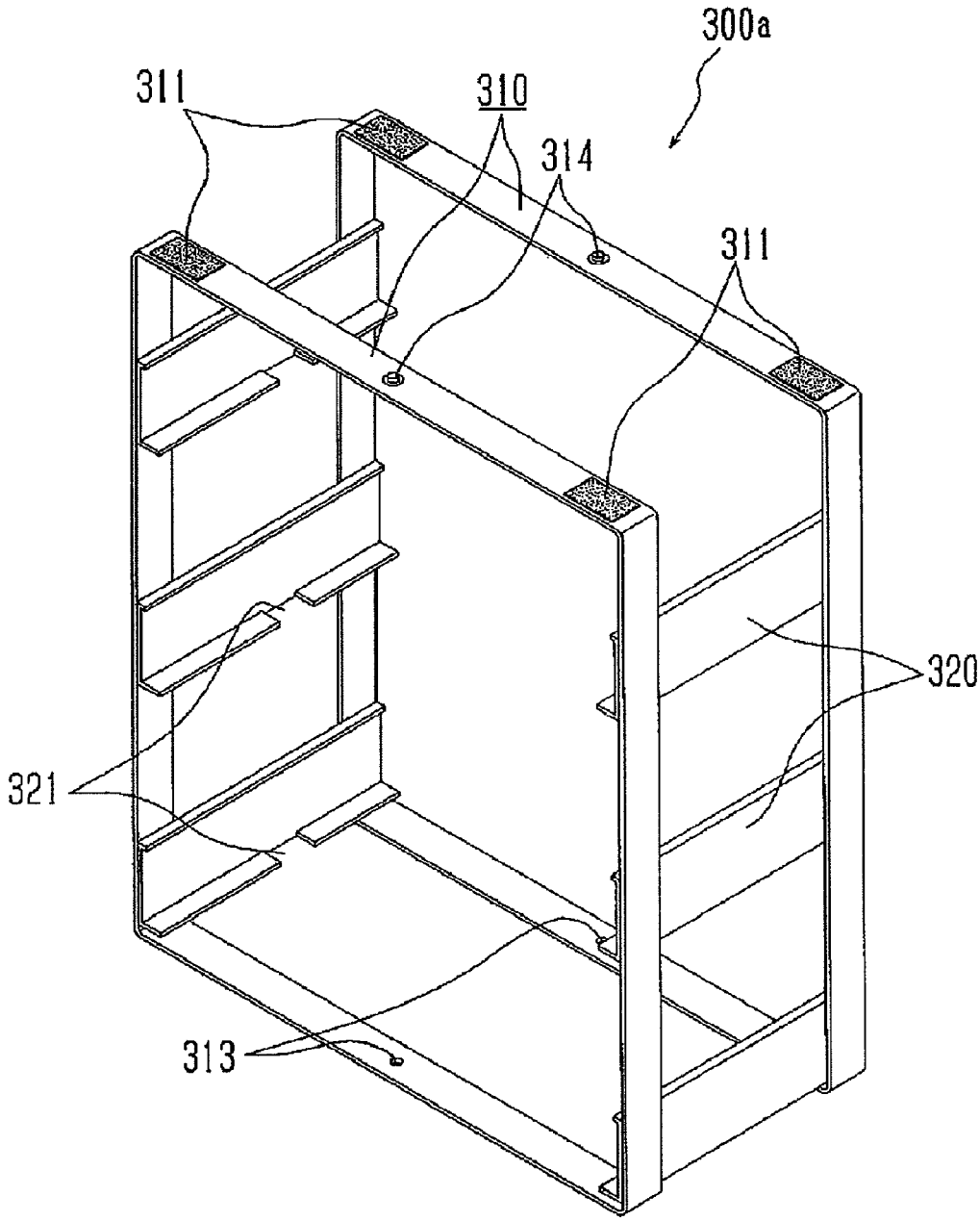
FIG. 9 is a perspective view showing one of four types of frame units.
Figure 10:
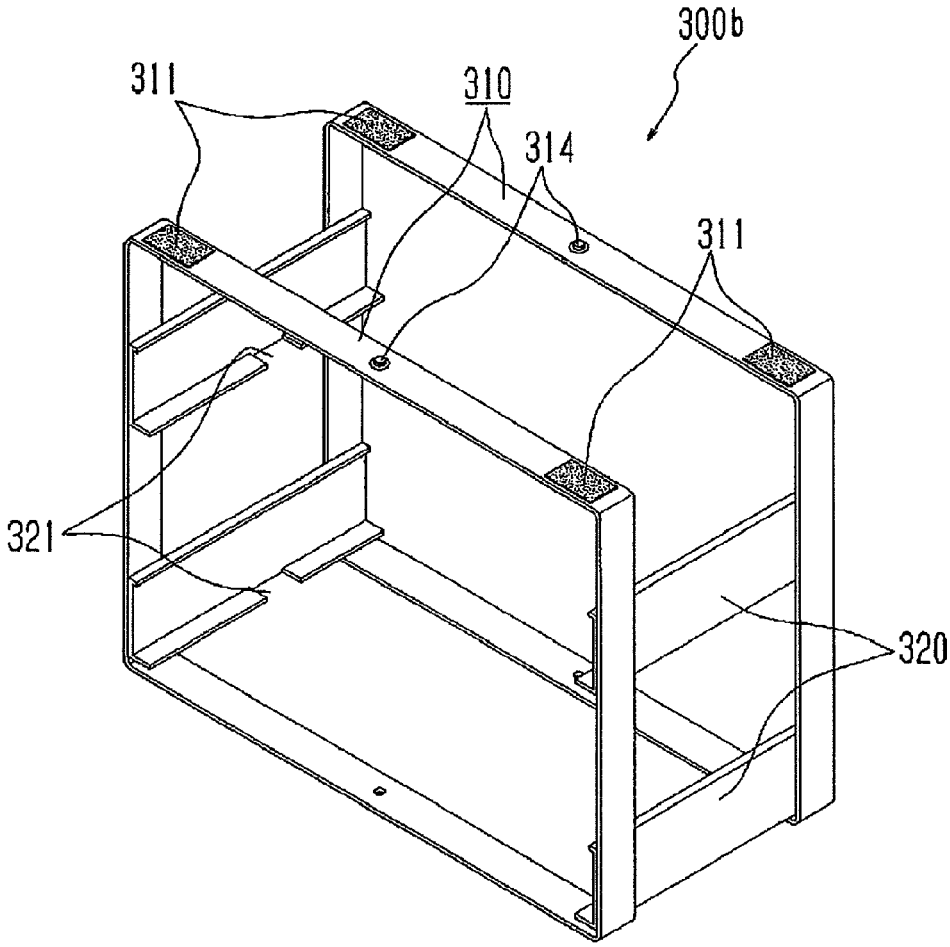
FIG. 10 is a perspective view showing one of the four types of frame units.
Figure 11:
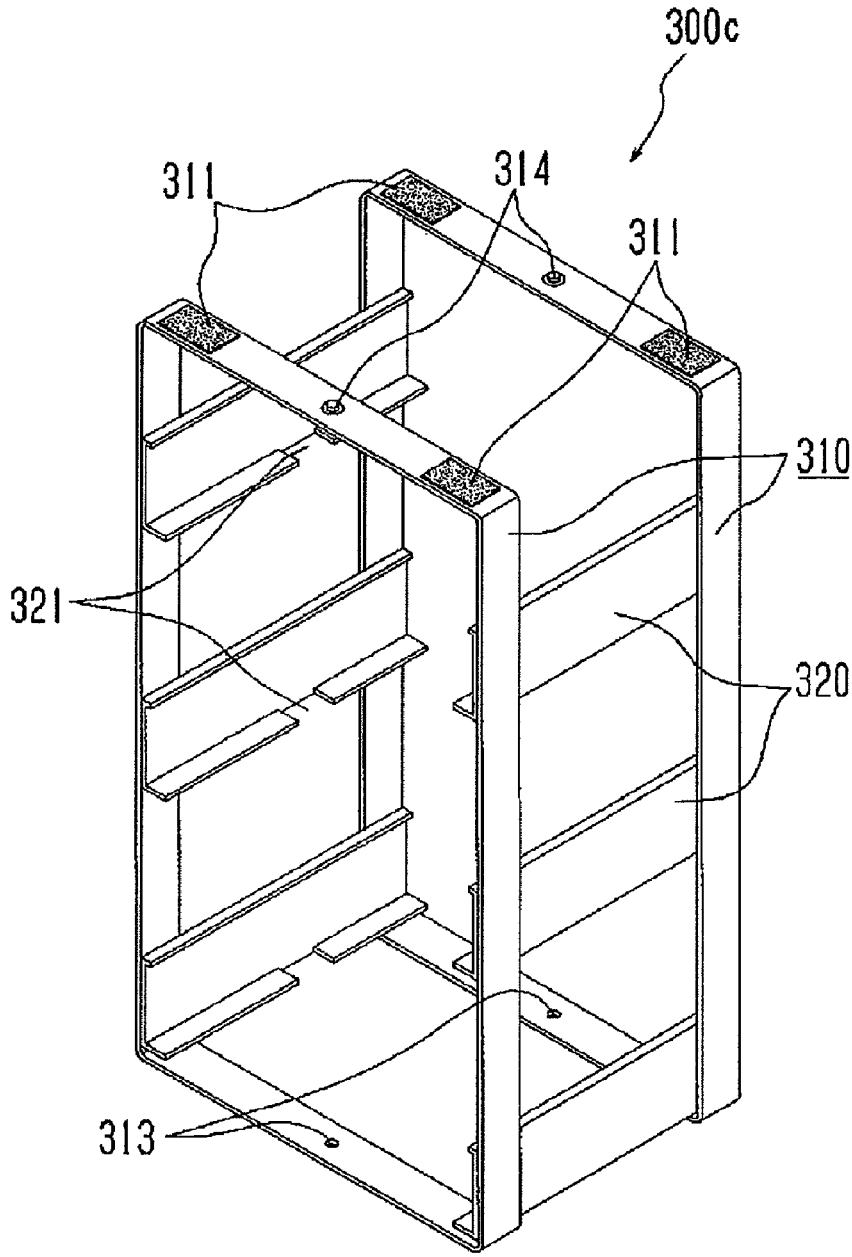
FIG. 11 is a perspective view showing one of the four types of frame units.
Figure 12:
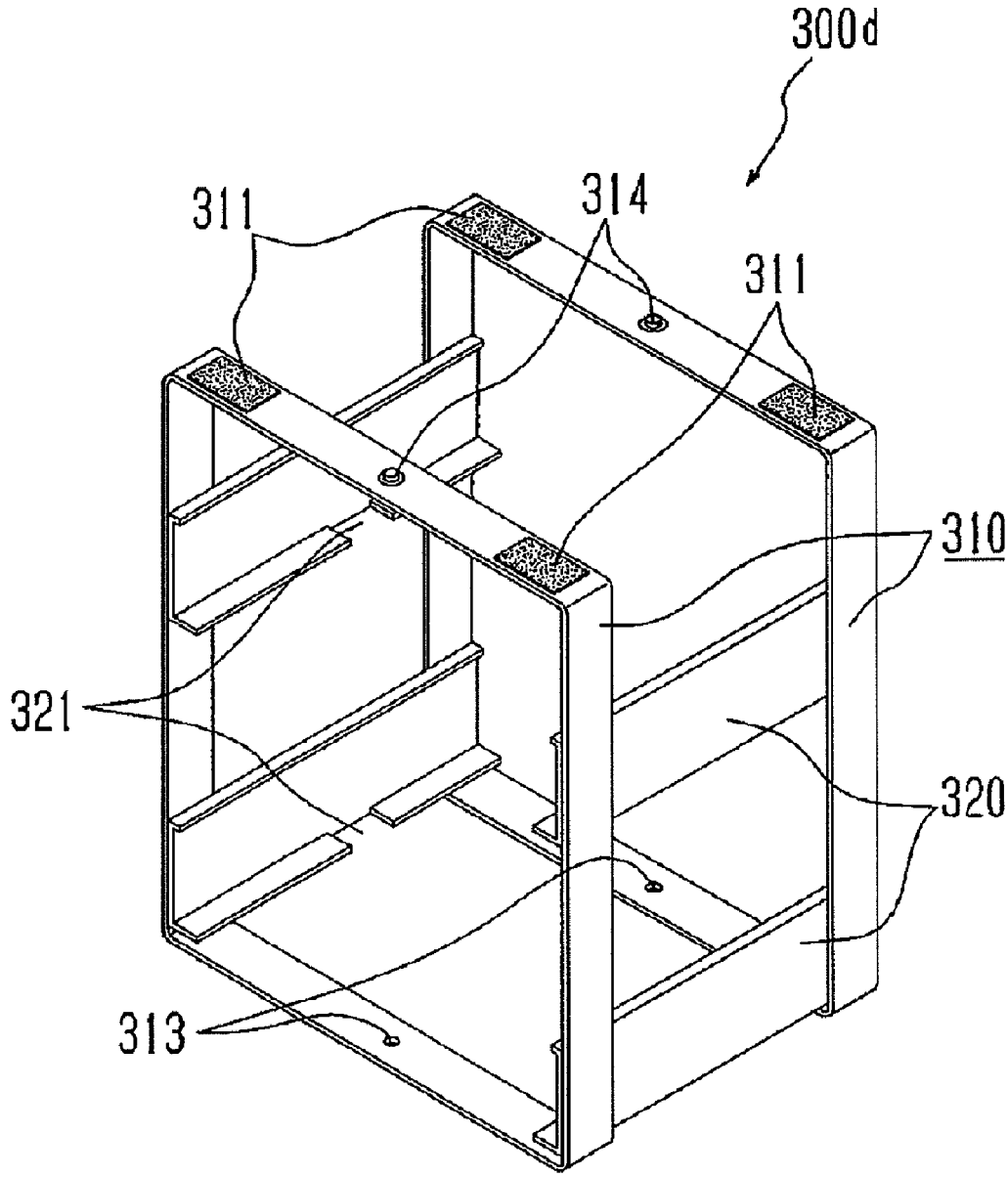
FIG. 12 is a perspective view showing one of the four types of frame units.

Generally, a brand name and the like are printed on the front surface (and the back surface) of the cigarette pack T. Therefore, the cigarette packs T are preferably displayed in a suitable condition in direction so that the front faces are located at front. As shown in FIGS. 2 to 4, the magazine unit 100 accommodates the cigarette packs T, which are facing in the appropriate direction as mentioned above and arranged in a direction from front to back.

Here, as shown in FIG. 2, the cigarette display system 1000 of the embodiment includes: a magazine unit 100*a*, which has a long length from front to back to hold thirteen cigarette packs T; and a magazine unit 100*b*, which has a short length from front to back to hold seven cigarette packs T.

The magazine unit 100 is formed by a colorless, transparent resin. Pockets 101, 102 having an opened top are formed at front end and back end of the magazine unit 100.

For example, a price tag of a cigarette pack T which is shown to customers is accommodated in the front pocket 101. For example, an information card of a cigarette pack T for a store clerk to check is accommodated in the back pocket 102.

An opening 104 elongated in a direction from front to back is formed at the bottom of the magazine unit 100, and a slider member 110 is attached to the opening 104 so as to be slidable in a direction from front to back.

As shown in FIG. 3, as for the slider member 110, a wound plate spring 111 is attached to a rear of the slider member 110 as an urging mechanism. One end of the plate spring 111 is pulled out from the bottom of the slider member 110 and attached to a front part of the magazine unit 100.

Accordingly, the slider member 110 is resiliently urged toward the front by the plate spring 111. Since the plate spring 111 pulled out from the slider member 110 is located inside the opening 104 of the magazine unit 100, the plate spring 111 does not come into contact with a bottom surface of the cigarette packs T accommodated in the magazine unit 100.

A stopper step 105 is formed at a rear bottom of the magazine unit 100. While being engaged with the stopper step 105, the slider member 110 stops against tension of the plate spring 111.

Further, a magazine protrusion 107 having a triangle shape of cross-section orthogonal to the lateral direction is formed at a front bottom of the magazine unit 100. The magazine protrusion 107 is formed to have a length from front to back same as that of a single cigarette pack T.

Accordingly, as shown in FIG. 4, among the plurality of cigarette packs T, which are accommodated in the magazine unit 100 and pushed by the slider member 110 toward the front, only one at the front end protrudes upward.

Although the magazine protrusion 107 is formed at front bottom of the magazine unit 100 as mentioned above, in the backward range from the protrusion 107 where the slider member 110 can make sliding movement, the bottom surface is made in a flat plane without a protrusion.

As shown in FIGS. 5 to 8, the tray unit 200 is also formed in the shape of a box having an opened top using a colorless, transparent resin. A plurality of magazine units 100 is accommodated in the tray unit 200 while the magazine units 100 are arranged in a lateral direction. There are two types of magazine units 100*a* and 100*b* which have different lengths from front to back, as mentioned above.

Here, the cigarette display system 1000 of the present embodiment includes a tray unit 200*a* which accommodates five magazine units 100*a* having a long length from front to back, a tray unit 200*b* which accommodates three magazine units 100*a* having a long length from front to back, a tray unit 200*c* which accommodates five magazine units 100*b* having a short length from front to back, and a tray unit 200*d* which accommodates three magazine units 100*b* having a short length from front to back.

Tray protrusions 201 are formed at both sides of the bottom surface of the tray unit 200. Although, there are four types of tray units 200 of combinations of two types of width and two types of lengths from front to back, as mentioned above, the length between the tray protrusion 201 and the front surface is common to all types of tray units. A pocket 202 which accommodates, for example, an advertisement card for a plurality of cigarette packs T is formed at a front part of the tray unit 200.

As shown in FIGS. 9 to 12, the frame unit 300 includes a pair of main frames 310 and a plurality of support frames 320. The main frame 310 is made of a metal plate which is bent so that a front shape becomes a rectangular. A pair of the main frames 310 is arranged in a direction from front to back.

The support frame 320 is made of a metal plate which is formed in a rail shape elongated in a direction from front to back for supporting the tray unit 200, and a plurality of support frames 320 are arranged in the vertical direction and joined to an inner surface of the pair of the main frame 310.

However, as mentioned above, there are two types of lateral widths in the tray units 200. Therefore, as shown in FIGS. 9 to 12, the cigarette display system 1000 of the present invention includes a frame unit 300*a* for holding three of the tray units 200*a*, 200*c* having a large lateral width, a frame unit 300*b* for holding two of the tray units 200*a*, 200*c* having the large lateral width, a frame unit 300*c* for holding three of the tray units 200*b*, 200*d* having a small lateral width, and a frame unit 300*d* for holding two of the tray units 200*b*, 200*d* having the small lateral width.

In the frame unit 300, a guide concave part 321 is formed in the support frame 320. The tray protrusion 201 of the tray unit 200 engages with the guide concave part 321. As mentioned above, although there are two types of lengths from front to back for the tray units 200, the lengths from their front surfaces to the tray protrusions 201 are common.

Figure 13:
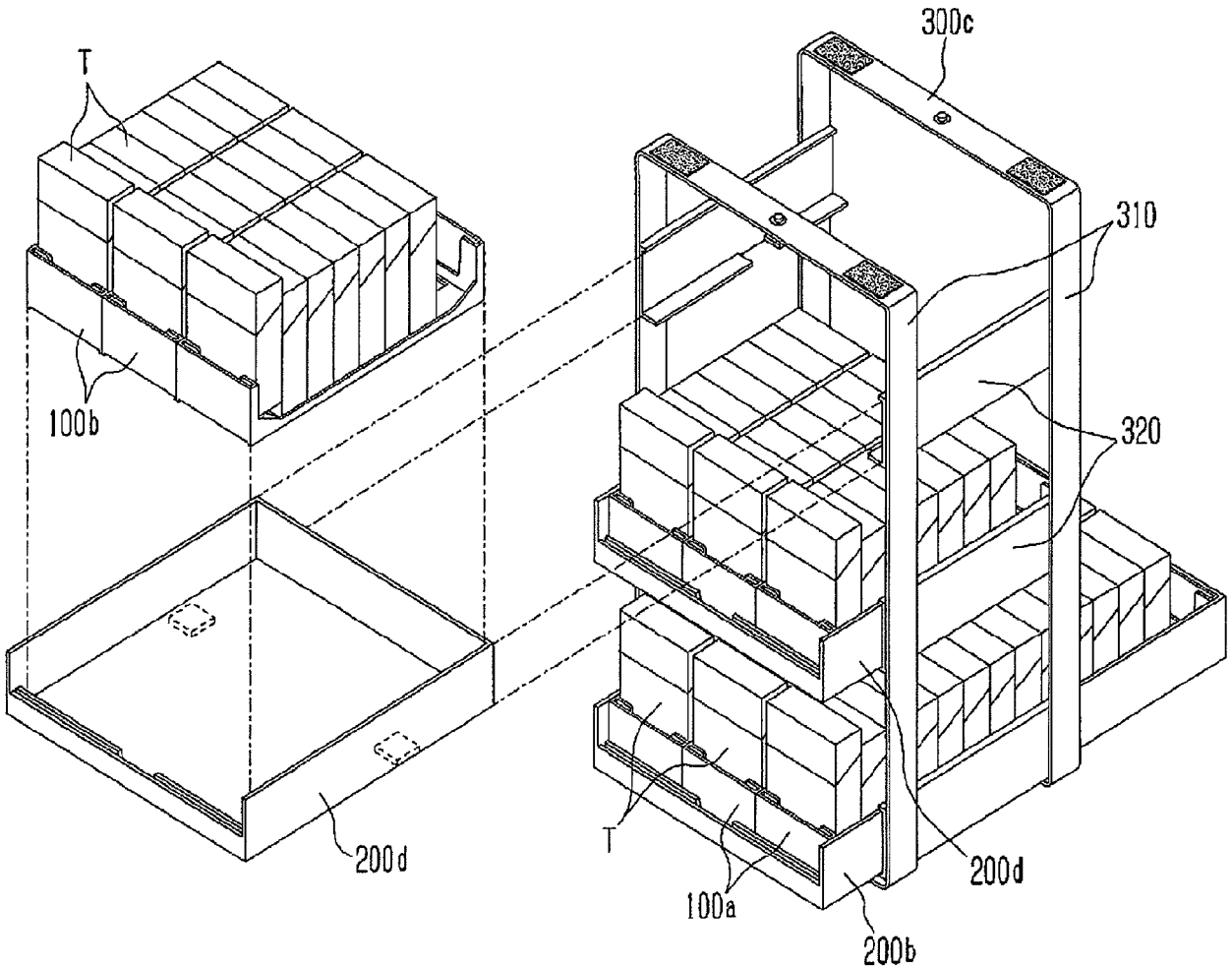
FIG. 13 is an exploded perspective view showing a condition where tray units in which cigarette packs are accommodated by magazine units are being set into one of the four types of frame units.

Further, as for the four types of frame units 300, the length from each front surface to the guide concave part 321 is common. Because of this, as shown in FIGS. 1 and 13, positions of the front surfaces of the tray units 200 held by the frame units 300 are lined up in well-positioned to be flush-fitting.

Figure 14:
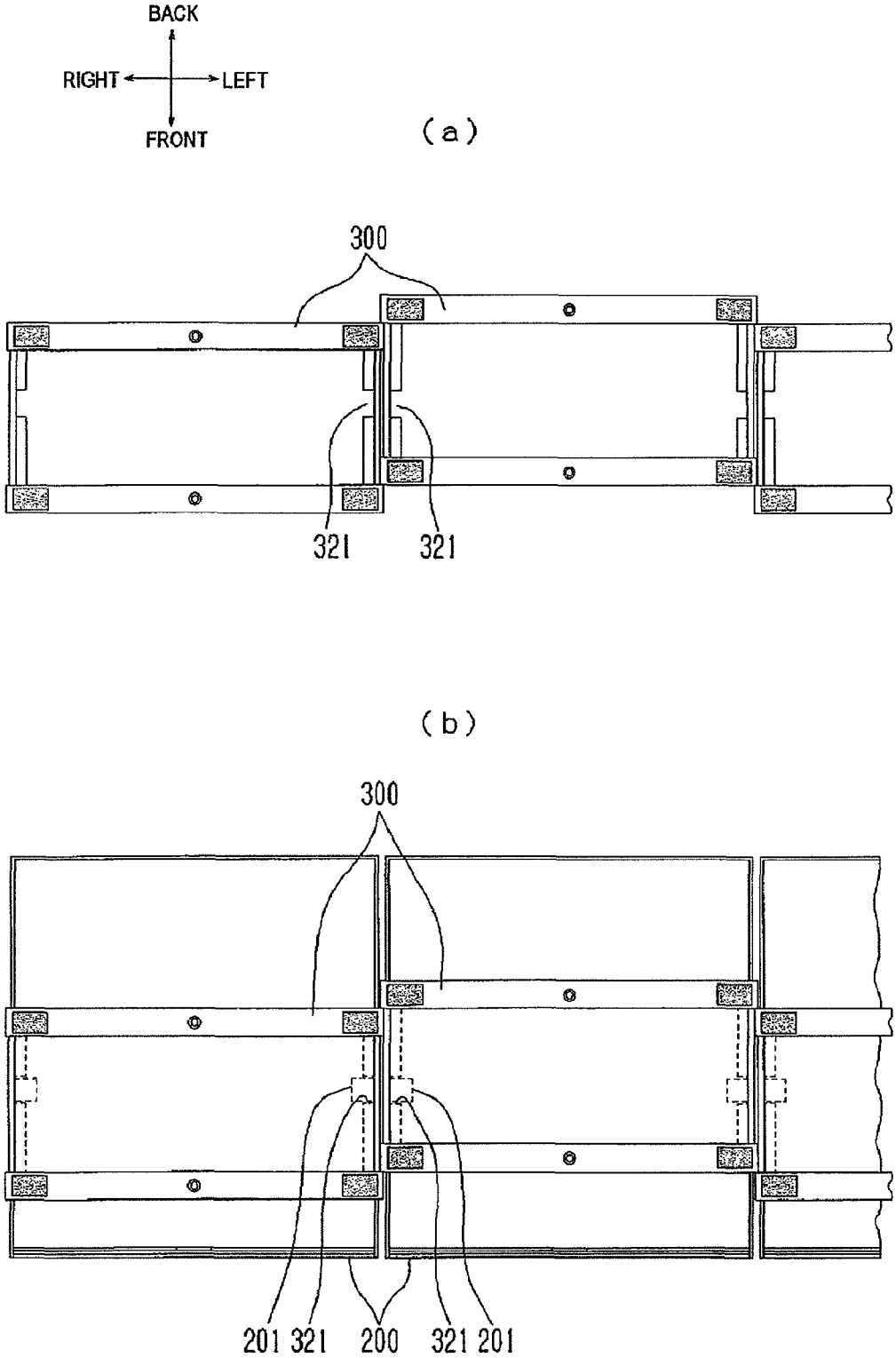
FIG. 14 is a plan view showing a relationship between a plurality of frame units and tray units both of which are arranged in a lateral direction.

Furthermore, as shown in FIG. 14(*a*), when a plurality of the frame units 300 are arranged in the left-right direction (lateral direction) while alternately front-back inverted such that the main frames 310 are adjacent to each other in the front-back direction, the positions of the guide concave parts 321 of each respective frame units 300 are lined up in well-positioned in the front-back direction.

In other words, when arranging a plurality of frame units 300 in the lateral direction, if odd-numbered frame units 300 and even-numbered frame units 300 are alternately front-back inverted and the main frames 310 are arranged to be adjacent to each other in a direction from front to back, positions of guide concave parts 321 of respective frame units 300 are matched in a direction from front to back. Therefore, as shown in FIG. 14(*b*), when the tray units 200 are mounted in the frame units 300 arranged in this way, positions of the front surface of the tray units 200 are lined up in well-positioned to be flush-fitting.

As shown in FIGS. 9 to 12, in the frame unit 300, surface fasteners 311, frame link mechanisms, are mounted on both sides of top surface and both sides of bottom surface of the main frames 310.

At the center of the bottom surface of the main frame 310, a frame through-hole 313 which serves as a frame concave part is formed. At the center of the top surface of the main frame 310, a protrusion part 314 which serves as a frame protrusion is formed.

In the cigarette display system 1000 of the embodiment, as shown in FIG. 1, when installing a plurality of frame units 300 having a same lateral width in the vertical direction, the plurality of frame units 300 are linked by the surface fasteners 311. At this time, the frame through-holes 313 engage with the protrusion parts 314.

Figure 15:
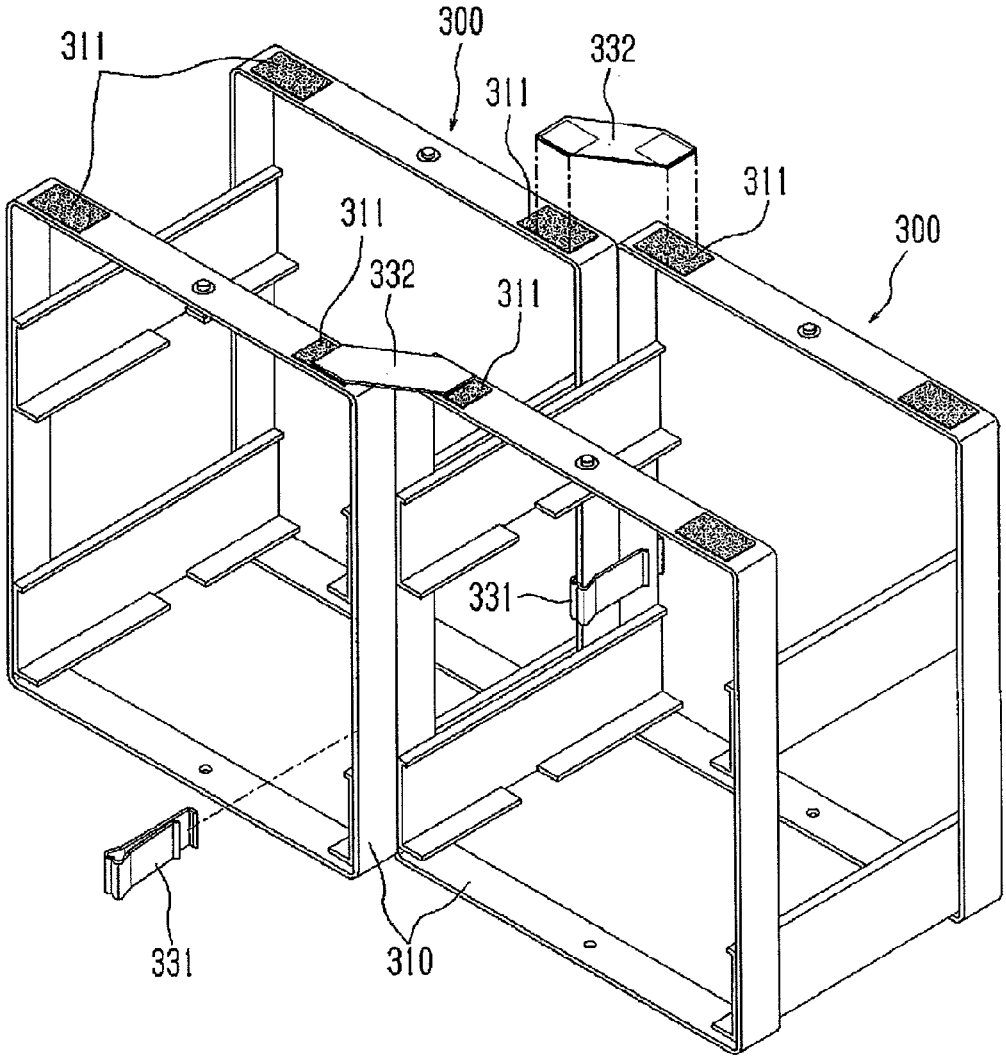
FIG. 15 is an exploded perspective view showing a condition in which a plurality of frame units arranged in the lateral direction are linked together by clip members and fastener members both of which are a lateral link mechanism.

As shown in FIG. 15, the cigarette display system 1000 of the embodiment has clip members 331 and fastener members 332, which serve as lateral link mechanisms for holding a plurality of frame units 300 which are alternately front-back inverted and arranged in the lateral direction as mentioned above.

The clip members 331 are formed by a spring material, and resiliently hold the main frames 310 which are adjacent to each other in a direction from front to back as mentioned above. The fastener members 332 have a structure in which a pair of surface fasteners is attached to a bottom surface of a resin plate. And the fastener members 332 are joined to the surface fasteners 311 adjacent to each other on top surfaces of the plurality of frame units 300 arranged as mentioned above.

In a configuration as mentioned above, for the cigarette display system 1000 of the embodiment, as shown in FIG. 1, a user can freely make a combination of the four types of frame units 300*a* to 300*d*, the four types of tray units 200*a* to 200*d*, and the two types of magazine units 100*a* and 100*b*, as desired.

Because of this, the cigarette display system 1000 of the embodiment is allowed for various modifications in the overall shape to be suitable for an installation space. Therefore, it is possible to use a space effectively. Especially, since there are wide frame units 300*a*, 300*b* for holding five columns of cigarette packs T, and narrow frame units 300*c*, 300*d* for holding three columns of cigarette packs T, the cigarette display system 1000 can be set up so as to fit various width installation spaces.

Further, since there are tall frame units 300*a*, 300*c* for holding three rows of cigarette packs T, and short frame units 300*b*, 300*d* for holding two rows of cigarette packs T, the cigarette display system 1000 can be set up so as to fit various height installation spaces.

The frame units 300*a* to 300*d* are linked in the vertical direction in a combination of frame units having the same width, while there is no limit on the combination of the frame units 300*a* to 300*d* when they are arranged in the lateral direction.

The tray units 200*a* to 200*d* are held by the frame units 300*a* to 300*d* having corresponding lateral widths, while there is no limit on a length from front to back of the tray unit 200 held by the frame unit 300.

Further, two or three tray units 200 are held by the frame unit 300. There is no limit on the minimum number of the tray units 200 held by the frame unit 300.

The magazine units 100*a*, 100*b* are held by the tray units 200*a* to 200*d* having corresponding lengths from front to back. However, the tray unit 200 can directly hold the cigarette carton K, the simple fittings F of the campaign packs P and the like rather than holding the magazine unit 100. In short, it is possible to display the cigarette carton K, the simple fittings F and the like, which have a shape that cannot be accommodated in the magazine unit 100.

In the cigarette display system 1000 of the embodiment, there is a plurality of types of frame units 300, tray units 200, and magazine units 100 as described above, which results in an extremely high flexibility in their combination.

Accordingly, an owner or the like of a store selling the cigarette packs T can freely change the display configuration. Therefore, since an installation area and a display configuration of the cigarette packs T are flexible, it is possible to set up a sales space which can attract attention effectively.

The owner or the like of the store can actively design a cigarette pack display configuration to set up a sales space which can attract attention effectively. Furthermore, companies which provide the cigarette packs T to stores can propose new display configurations.

In addition, the frame units 300 are joined together in the vertical direction by the surface fasteners 311. Because of this, a plurality of frame units 300 can be joined together simply in the vertical direction without any tool or the like.

Further, a product which is used to join parts of automobiles can be used as the surface fastener 311. In that case, a plurality of frame units 300 can be joined together strongly by the surface fasteners 311.

Because of this, the cigarette display system 1000 which is large and strong as a whole can be simply set up by using small and lightweight frame units 300. Especially, since the cigarette packs T to be accommodated are lightweight, the cigarette display system 1000 relatively has high strength.

Furthermore, when a plurality of frame units 300 are linked together in the vertical direction as mentioned above, a pair of the protrusion parts 314 of a lower frame unit 300 engages with a pair of the through-holes of an upper frame unit 300. Because of this, relative locations in the direction from front to back and the lateral direction of a plurality of frame units 300 linked together in the vertical direction can be corrected easily and reliably.

As shown in FIG. 15, in the cigarette display system 1000 of the embodiment, it is possible to link, in the lateral direction, a plurality of frame units 300 which are arranged in the lateral direction while alternately front-back inverted as mentioned above, by using the clip members 331 and the fastener members 332.

Because of this, a plurality of frame units 300 can be linked together easily also in the lateral direction without requiring any tool or the like. Further, the surface fasteners 311 for linking the frame units 300 in the vertical direction are effectively used also for linking of the lateral direction as mentioned above.

The cigarette display system 1000 of the embodiment can be brought in while disassembled into each part, and can be assembled without using tools. Therefore, bringing in and installation of the cigarette display system can be performed quickly while using a small space.

For example, for a 24-hour convenience store, bringing in and installation of the cigarette display system 1000 need to be performed when a store is open to customers. However, as mentioned above, the cigarette display system 1000 can be quickly brought in and installed using a small space. Therefore, it does not disturb a sales operation of the convenience store and the like.

Furthermore, when the tray unit 200 is held by the frame unit 300 as mentioned above, the tray protrusion part 201 engages with the guide concave part 321. Because of this, the tray unit 200 is easily and securely held by the frame unit 300 in a correct position.

In addition, although there is a plurality of types of tray units 200 having different lengths from front to back, the length from their front surfaces to the tray protrusion part 201 is common. And, as for a plurality of types of frame units 300, the length from their front surfaces to the guide concave part 321 is common. Because of this, even when a plurality of types of tray units 200 are held by a plurality of types of frame units 300, positions of the front surfaces of the tray units 200 are lined up in well-positioned.

Furthermore, when a plurality of frame units 300 are arranged in the lateral direction, if the frame units 300 are alternately front-back inverted, positions of guide concave parts 321 of the support frames 320 are lined up in well-positioned in a direction from front to back.

Because of this, even when the tray units 200 are held by a plurality of frame units 300 arranged in the lateral direction as mentioned above, positions of the front surfaces of the tray units 200 are lined up in well-positioned.

Therefore, in the cigarette display system 1000 of the embodiment, it is possible that positions of the front surfaces of the cigarette packs T displayed while being held by a plurality of units 100 to 300 are lined up in well-positioned, whereby the cigarette packs T can be displayed beautifully.

Especially, the magazine unit 100 pushes forward a plurality of accommodated cigarette packs T by the slider member 110. Because of this, the cigarette packs T accommodated in a plurality of magazine units 100 can be automatically displayed in a common position.

In addition, the magazine unit 100 pushes up only one at the front end of the cigarette packs T accommodated by the magazine protrusion 107. Accordingly, it is easy to pick up a single cigarette pack from the accommodated plurality of cigarette packs T.

Therefore, by installing the cigarette display system 1000 in a sales space facing customers, it is possible that a customer picks up a desired cigarette pack T or the like, while the cigarette packs T or the like are favorably displayed to customers.

In the magazine unit 100, as shown in FIG. 3, by engaging the slider member 110, which is placed backward by sliding movement, with the stopper step 105, the slider member 110 can be stopped against the tension of the plate spring 111. Accordingly, it is easy to replenish a plurality of cigarette packs T in the magazine unit 100.

Furthermore, when a plurality of frame units 300 are arranged in the lateral direction in a condition in which their direction from front to back are alternately inverted, it is possible to minimize gaps between the plurality of frame units 300 arranged in the lateral direction. Because of this, a display density of the cigarette packs T can be increased.

As for the frame unit 300, a plurality of support frames 320, each of which supports the tray unit 200, are arranged in the vertical direction and supported by a pair of main frames 310, and the pair of main frames 310 is arranged in a direction from front to back and supported by the plurality of support frames 320.

In short, the frame unit 300 is formed by bare minimum of the frames 310 and 320 which work as both functional parts and structural bodies. Because of this, the productivity of the frame units 300 becomes good and the frame unit 300 becomes lightweight.

Especially, since the support frame 320 is bent to have a cross-section of a square bracket shape, the support frame 320 has high rigidity. Since the main frame 310 is formed in a closed frame shape, the main frame 310 has high rigidity. And, these frames 310 and 320 are joined together in three dimensions. Because of this, the frame unit 300 has extremely high rigidity compared with conventional fittings formed by metal bars or the like.

Further, a lateral width of the tray unit 200*a*, 200*c* which holds five magazine units 100 are slightly longer than a total length of the cigarette carton K. Therefore, in the cigarette display system 1000 of the embodiment, as shown in FIG. 1, it is possible to accommodate the cigarette cartons K in the tray units 200*a* and 200*c* while the longest sides of the cigarette cartons K placed in a lateral direction.

Furthermore, the simple fittings F, in which the campaign pack P is set, or the like can also be placed on the tray units 200*a*, 200*c* (not shown). And, as shown in FIG. 1, it is possible to place the above mentioned simple fittings F on an upper surface of the frame unit 300, and also it is possible to arrange the simple fittings F inside the frame unit 300 in which the tray units 200 are not set (not shown).

Since the cigarette display system 1000 of the embodiment can be assembled by a freely combining the frame units 300, the tray units 200, and magazine units 100 as mentioned above, it is easy to disassemble a part of the cigarette display system 1000 and clean it.

Especially, the magazine unit 100 of the embodiment has a flat bottom surface having no protrusion, at least in a range where sliding movement is allowed for the slider member 100. Accordingly, the bottom surface of the magazine unit 100, on which the cigarette packs T are directly placed and which is easy to be dirty, can be easily washed or cleaned.

Further, the magazine units 100 and the tray units 200 are formed by a colorless, transparent resin. Accordingly, it is possible to display the cigarette cartons K accommodated in the tray units 200 and the cigarette packs T accommodated in the tray units 200 by using the magazine units 100, in a condition in which they are favorably seen.

At present, the cigarette packs T and the cigarette cartons K are packed in a cardboard box and provided to a store, and they are replenished into the magazine units 100 or the tray units 200 of the cigarette display system 1000 in the store.

However, it is also possible to provide the magazine units 100 filled with the cigarette packs T and the tray units 200 filled with the cigarette cartons K to a store, and collect empty magazine units 100 and empty tray units 200 from the store. In this case, since the operation to replenish the cigarette packs T and the cigarette cartons K into the magazine units 100 and the tray units 200 is not needed in the store, it is possible to increase sales efficiency.

The present invention is not limited to the embodiment, and various modifications are allowed without departing from the scope of the invention. For example, in the above embodiment, it is exemplified that the cigarette display system 1000 includes the magazine units 100, the tray units 200, and the frame units 300.

Figure 16:
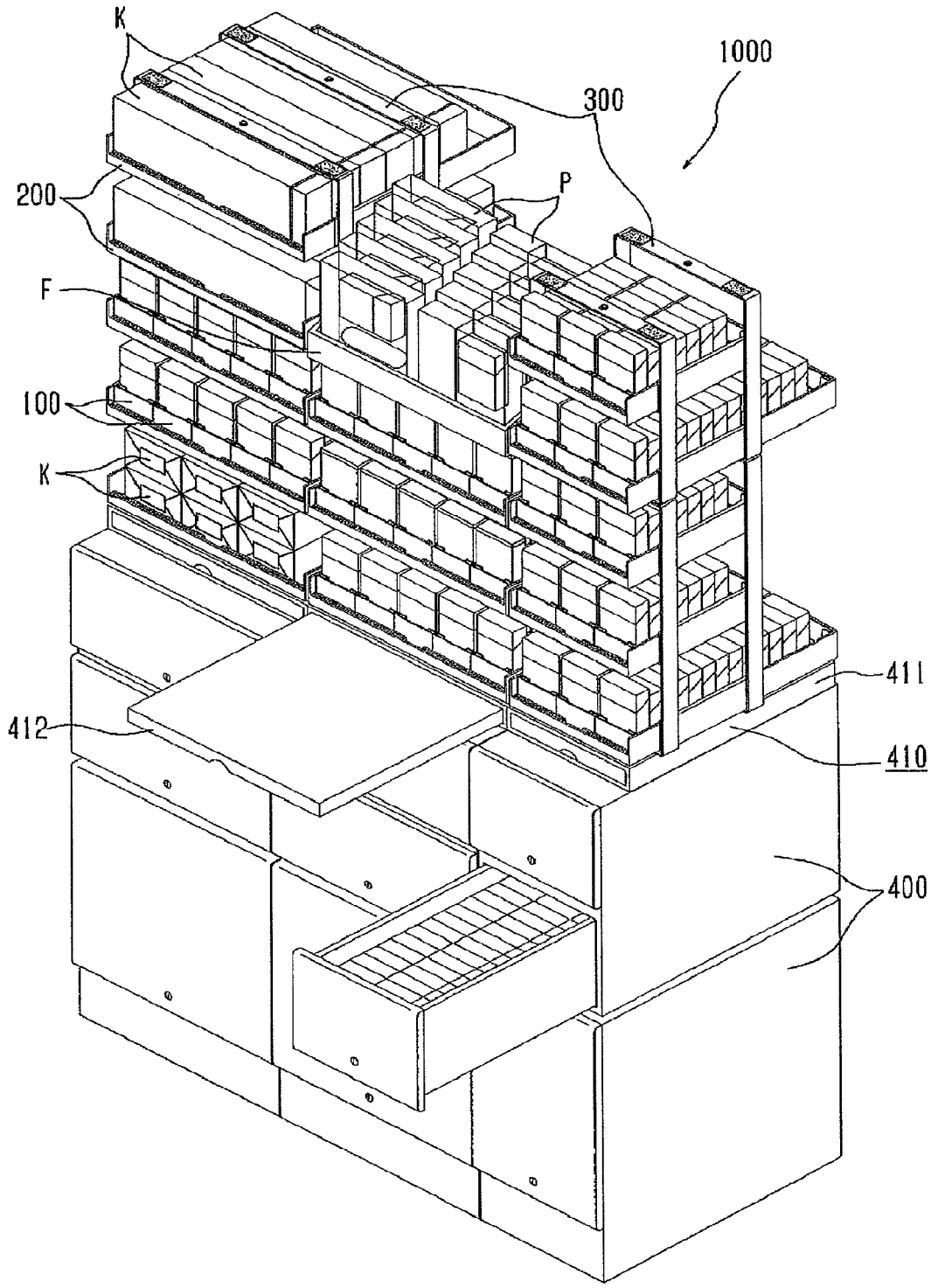
FIG. 16 is a perspective view showing an appearance of a modification of the cigarette display system having stocker units.

However, as shown in FIG. 16, the cigarette display system 1000 can further includes stocker units 400 and table units 410. The stocker unit 400 is formed in the shape of a box having at least a flat top surface and a front surface, which can be opened and closed.

The table unit 410 is formed in the shape of a vertically flattened box having a flat top surface. In the table unit 410, a table part 412 is accommodated in a unit box 411 while allowing sliding movement of the table part 412 in a direction from front to back. Accordingly, it is possible to protrude the table part 412 forward and use it for a work.

Since the frame unit 300 has two types of lateral widths as described above, the above mentioned stocker units 400 and the table units 410 are formed to have two types of lateral widths which correspond to those of the frame units 300.

Because of this, it is possible to combine the stocker units 400 and the table units 410 corresponding to the frame units 300 to be used. Therefore, the cigarette display system 1000, as a whole, can have an appearance of unity, and generation of dead space can be prevented effectively.

In addition, as mentioned above, since the tray units 200 have two types of lengths from front to back, the above mentioned stocker units 400 and table units 410 are formed to have a length from front to back corresponding to that of the tray units 200*a* and 200*b* which have a longest length from front to back. Therefore, the tray unit 200 does not protrude outside the stocker unit 400, even when any type of tray unit 200 is used.

By using the stoker units 400 as mentioned above, the cigarette display system 1000 can be installed in a suitable condition even in a space having no counter. Furthermore, by using the table units 410 as mentioned above, it is possible to increase operational efficiency when replenishing the cigarette packs T, and at the same time the table units 410 are not cumbersome when not in use.

The stocker units 400 and the table units 410 may have a structure which can be linked in the vertical direction by using recesses/protrusions and surface fasteners formed on the top surface and the bottom surface (not shown), for example, similarly to the frame units 300.

In this case, for example, by making locations and structures of the recesses/protrusions and the surface fasteners common to the frame units 300, the frame units 300 can be correctly, easily and securely mounted on the stocker units 400 and table units 410.

Figure 17:
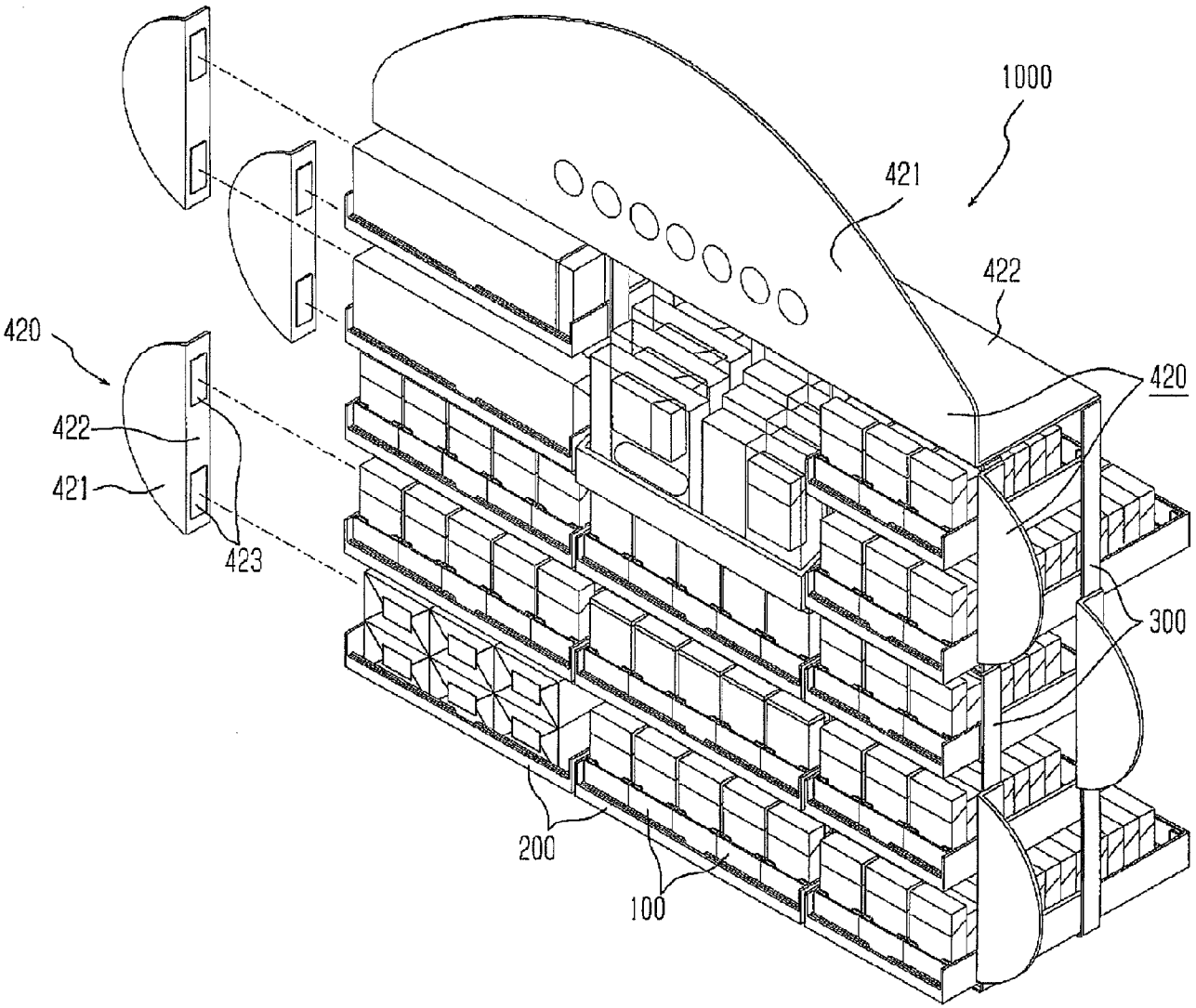
FIG. 17 is an exploded perspective view showing an appearance of another modification of the cigarette display system having presentment parts.

Furthermore, as shown in FIG. 17, the cigarette display system 1000 may further include presentment parts 420. The presentment parts 420 are made of a resin panel having a cross-section of L-shape, for example. Front parts 421 of the presentment parts 420 are formed to be an advertisement or decoration.

Magnets 423 sticking to the main frame 310 of the frame unit 300 are attached to parts 422 orthogonal to the above mentioned parts. Because of this, it is possible to easily attach the presentment parts 420 on the top surface and the side surfaces of the frame units 300. For example, when changing the cigarette packs T to be sold, it is easy to change the presentment parts 420. Also, the presentment parts 420 as mentioned above can be formed to have a total length corresponding to the vertical heights and the lateral widths of the plurality of types of frame units 300.

It is possible to attach surface fasteners on the presentment parts 420 as mentioned above, and these surface fasteners may be joined to the surface fasteners 311 on the top surface of the frame unit 300. In this case, the presentment parts 420 can be more securely attached to the top surfaces of the frame units 300. Further, the frame units 300 arranged in the lateral direction can be linked by the presentment parts 420.

Further, in the above embodiment, it is exemplified that the slider member 110 which pushes the cigarette packs T forward by the resilient force of the plate spring 111 is attached to the magazine unit 100, and the cigarette cartons K can be directly accommodated in the tray unit 200.

However, the slider member 110 which pushes the cigarette cartons K forward by the resilient force of the plate spring 111 can be mounted in the tray unit 200. In that case, as shown in FIGS. 18 and 19, slider units 430 detachably attached to the tray unit 200 are prepared.

Figure 18:
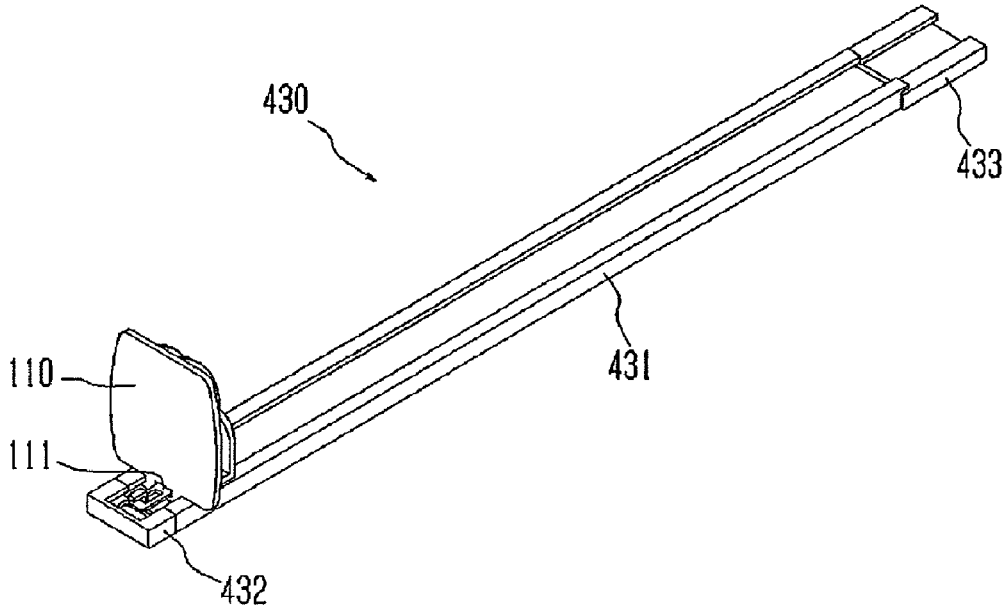
FIG. 18 is a perspective view showing appearances of a slider unit of another modification.

As shown in FIG. 18, in the slider unit 430, resin parts 432, 433 are attached to the front and back end of the guide rail 431. The slider member 110 is supported by the guide rail 431 to allow sliding movement, and one end of the plate spring 111 wound at the rear of the slider member 110 is linked to the front resin part 432. On the bottom surface of the resin parts 432, 433, sticking parts (not shown) which physically stick to the tray unit 200 are attached.

Figure 19:
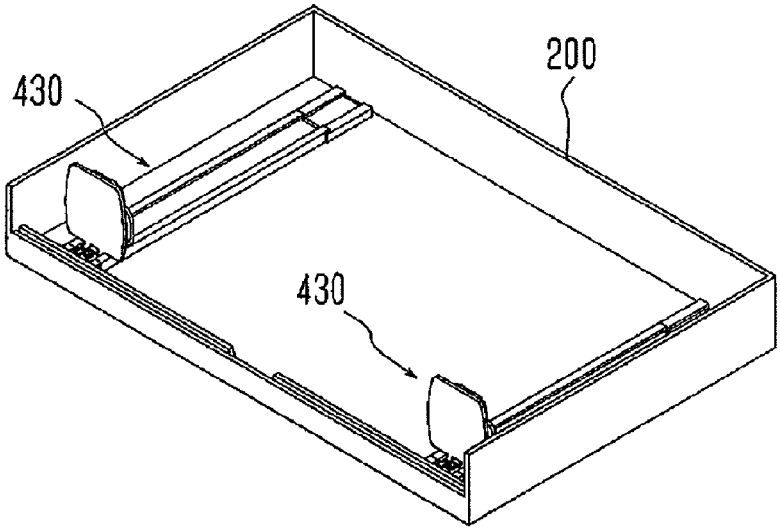
FIG. 19 is a perspective view showing a condition in which the slider units are attached to a tray unit.

Therefore, as shown in FIG. 19, by attaching a pair of the slider units 430 to the bottom surface of the tray unit 200, it is possible to push a plurality of cigarette cartons K forward accommodated in the tray unit 200 so that the cigarette carton K can be constantly located at the front end of the tray unit 200.

Figure 20:
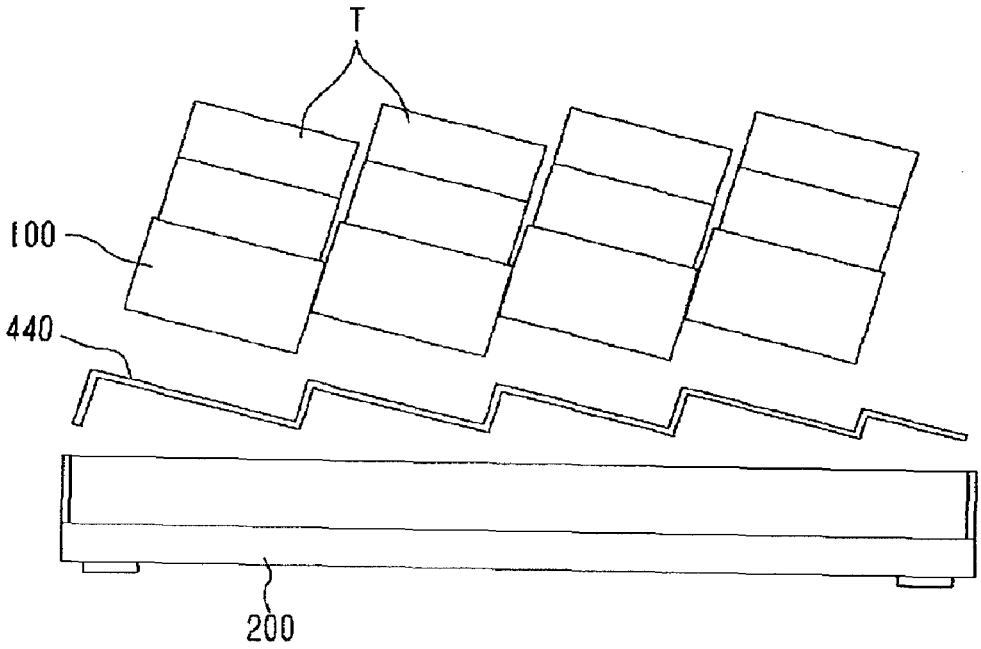
FIG. 20 is a plan view showing a condition of another modification in which cigarette packs are being accommodated in a tray unit using a resin panel.
Figure 20:
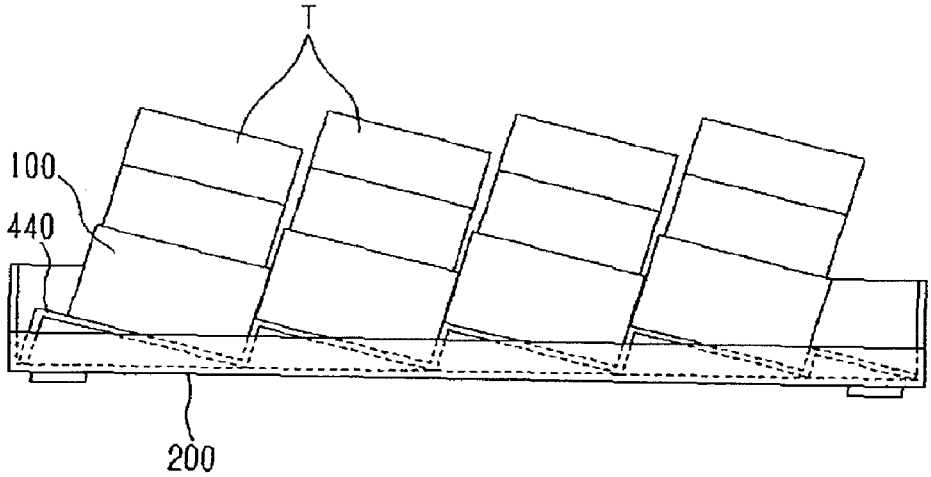

And, in the above embodiment, it is exemplified that the cigarette packs T are accommodated in the tray unit 200 in an upright condition using the magazine units 100. However, as shown in FIG. 20, it is possible to set a resin panel 440 having a bent shape into a waveform or the like on the bottom surface of the tray unit 200, and accommodate the cigarette packs T with the magazine units 100 in a slant condition into the tray unit 200.

In this case, since only four columns of cigarette packs T can be accommodated in the tray unit 200 which can accommodate five columns of cigarette packs T, the accommodation efficiency decreases. However, it is possible to make variations to the display of the cigarette packs T.

Further, in the above embodiment, it is exemplified that the magazine units 100 and the tray units 200 are formed by a colorless, transparent resin. However, the magazine units 100 or the like may be formed by a fluorescent colored resin.

In that case, for example, it is possible to accommodate and display general cigarette packs T in colorless, transparent magazine units 100, and accommodate and display newly marketed cigarette packs T in fluorescent colored magazine units 100. In this case, it is possible to favorably attract attention to specific cigarette packs T.

Figure 21:
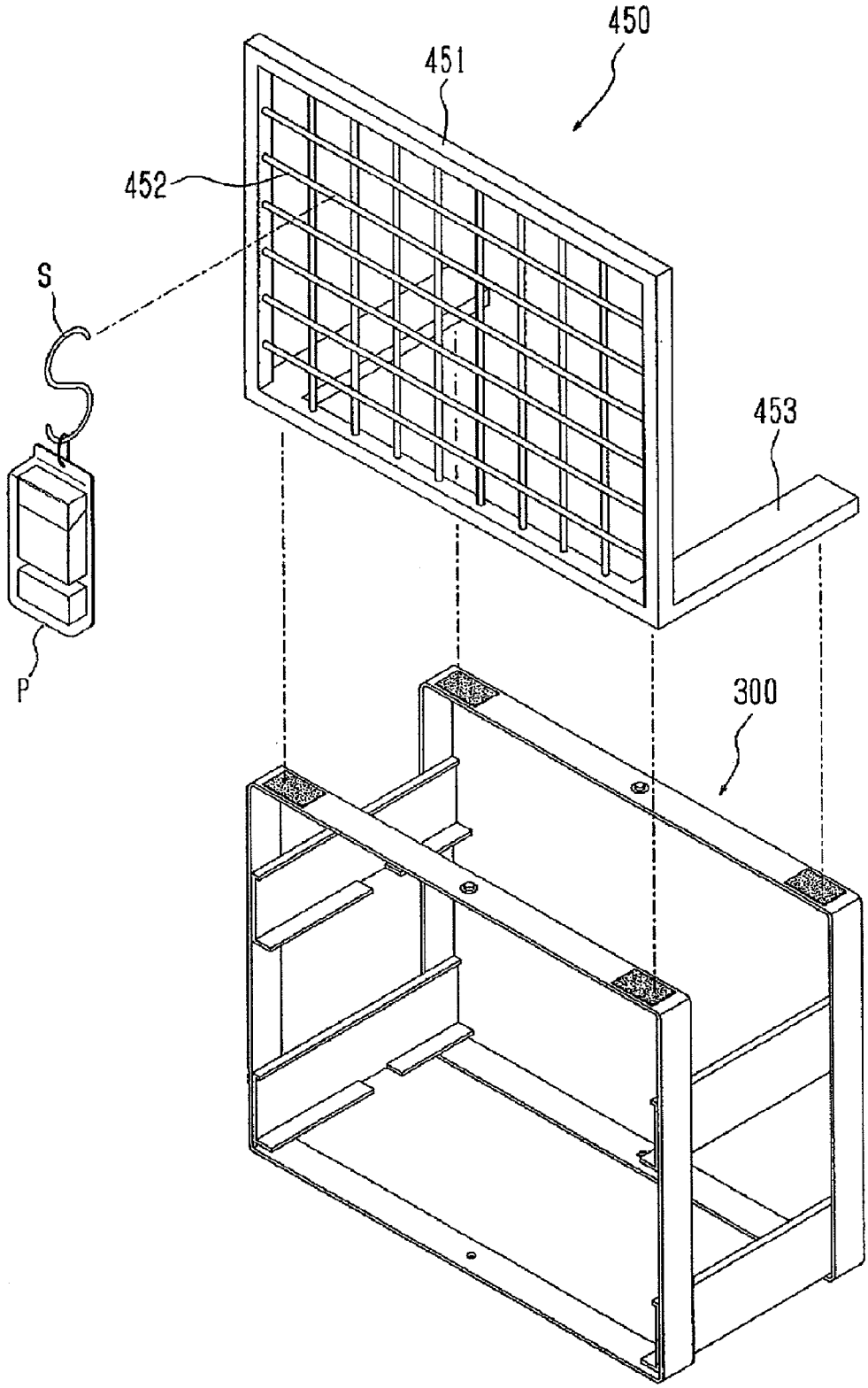
FIG. 21 is a perspective view showing a condition of another modification in which a campaign pack of a cigarette pack is being displayed by using a mesh unit.

And, in the above embodiment, it is exemplified that the cigarette packs T, the campaign packs P, and the like are displayed in the frame units 300 by using the tray units 200, the magazine units 100 and the like. However, as shown in FIG. 21, the campaign pack P and the like may be displayed by using a mesh unit 450 which is detachably attached to the frame unit 300.

The mesh unit 450 has a frame part 451 whose front surface shape is rectangle, a mesh part 452 arranged within the frame part 451, and a base part 453 extending backward from a bottom part of the frame part 451.

The base part 453 is formed to have a lateral width and a length from front to back corresponding to the top surface of the frame unit 300. On the bottom surface of the base part 453 of the mesh unit 450, surface fasteners (not shown) are attached. These surface fasteners are detachably attached to the surface fasteners 311 on the top surface of the frame unit 300.

When such a mesh unit 450 is attached on the top surface of the frame unit 300, it becomes possible to suspend the campaign pack P on the mesh part 452 by using an S pipe S.

Furthermore, in the above embodiment, it is exemplified that the cigarette display system 1000 includes the magazine units 100, the tray units 200, and the frame units 300. However, as shown in FIGS. 22 to 26, the cigarette display system 1000 can further include wall units 500 and tray attachments 600.

Figure 22:
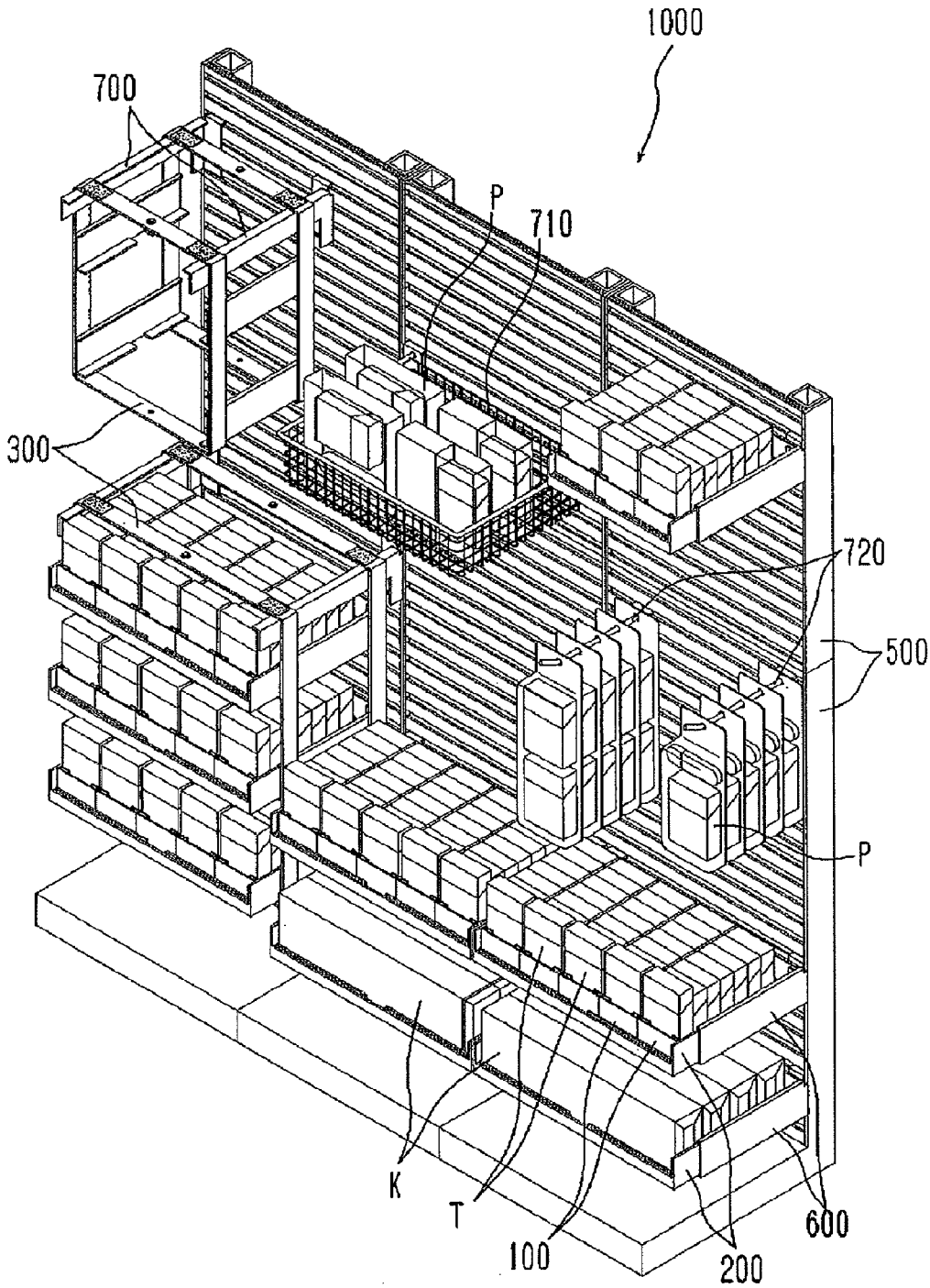
FIG. 22 is a perspective view showing an appearance of another modification of the cigarette display system which uses wall units.
Figure 23:
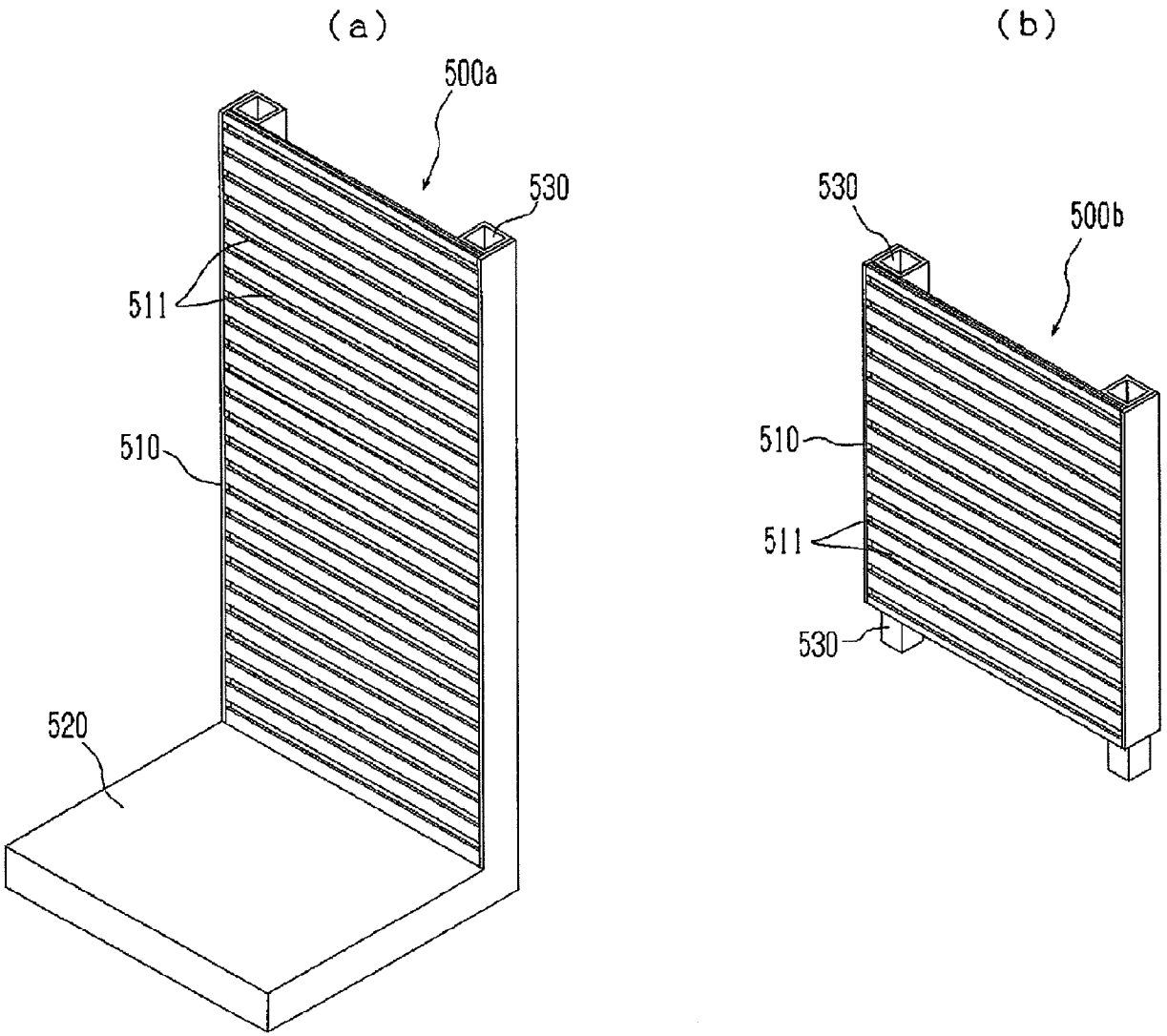
FIG. 23 is a perspective view showing appearances of two types of wall units.

In that case, as shown in FIG. 22, the cigarette display system 1000 can be set up by using the wall units 500 without using the frame units 300. Regarding the wall units 500, as shown in FIG. 23, there are a base wall 500*a* and a panel wall 500*b*.

The base wall 500*a* and the panel wall 500*b* have a wall part 510 which has a flat plate shape flattened in a direction from front to back. In the base wall 500*a*, a pedestal 520 is integrally formed at a bottom end of the wall part 510, and a wall link mechanism 530 is mounted at a top end of the wall part 510.

And, recesses and protrusions of a predetermined shape are formed on a front surface of the wall part 510 of the wall unit 500. More specifically, as recesses and protrusions, concavity channels 511 running through in the lateral direction are arranged at a predetermined interval in the vertical direction. For example, the concavity channel 511 is formed to have a cross-section of L-shape whose back part is bent downward.

A plurality of panel walls 500*b* can be linked in the vertical direction, and also linked to a top end of the base wall 500*a*. Therefore, it is possible to form the wall units 500 having a desired height.

Figure 24:
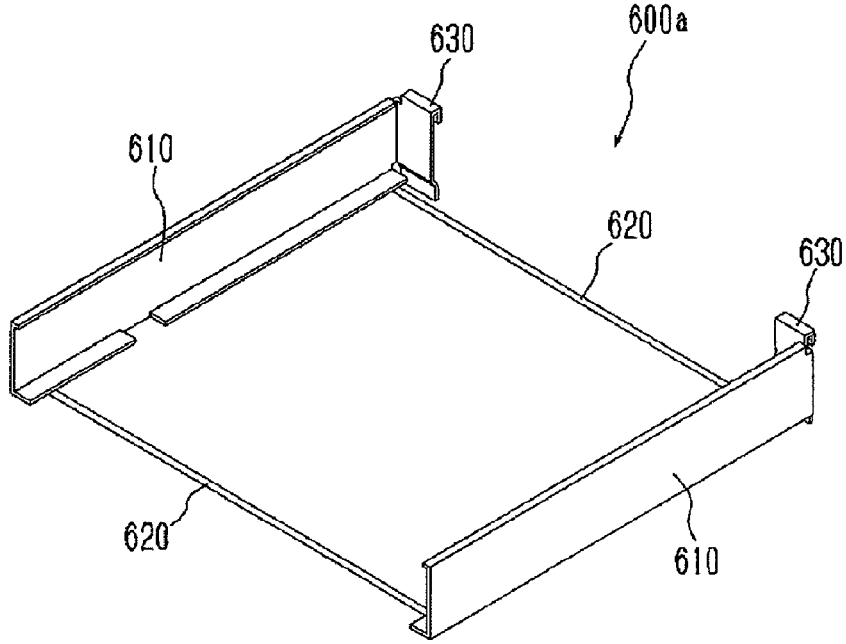
FIG. 24 is a perspective view showing two appearances of four types of tray attachments.
Figure 24:
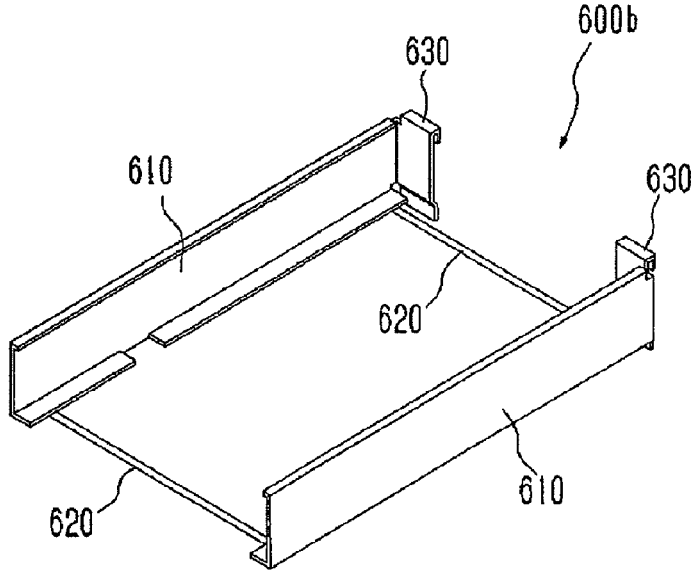
Figure 25:
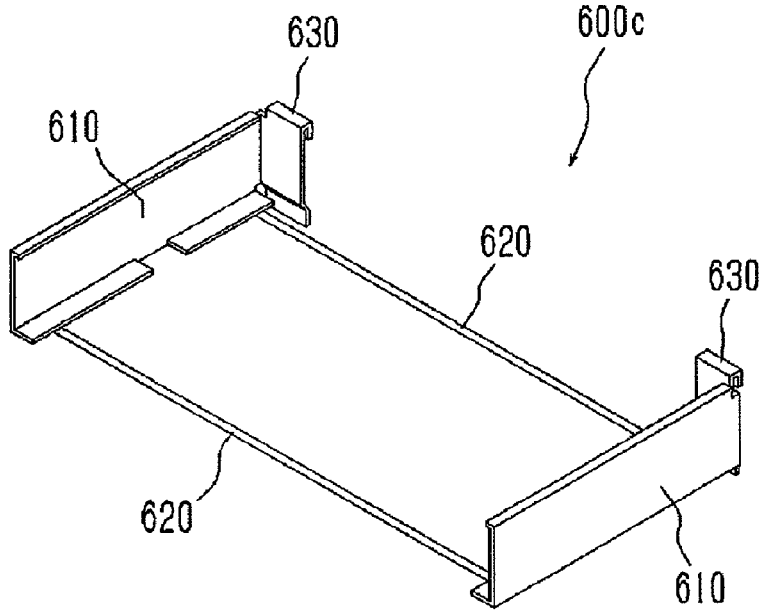
FIG. 25 is a perspective view showing two appearances of four types of tray attachments.
Figure 25:
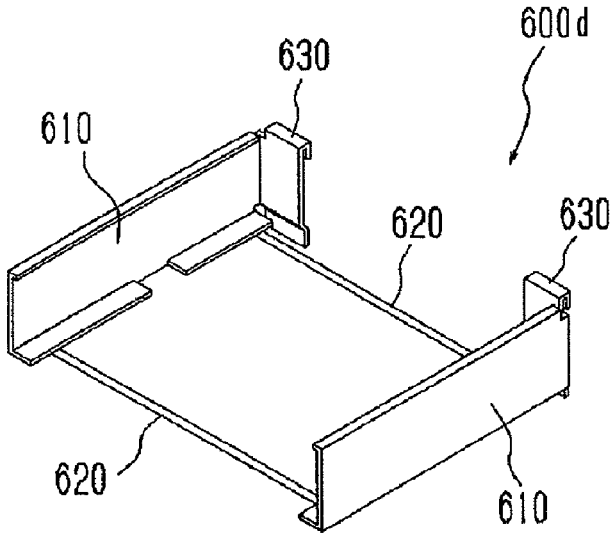
Figure 26:
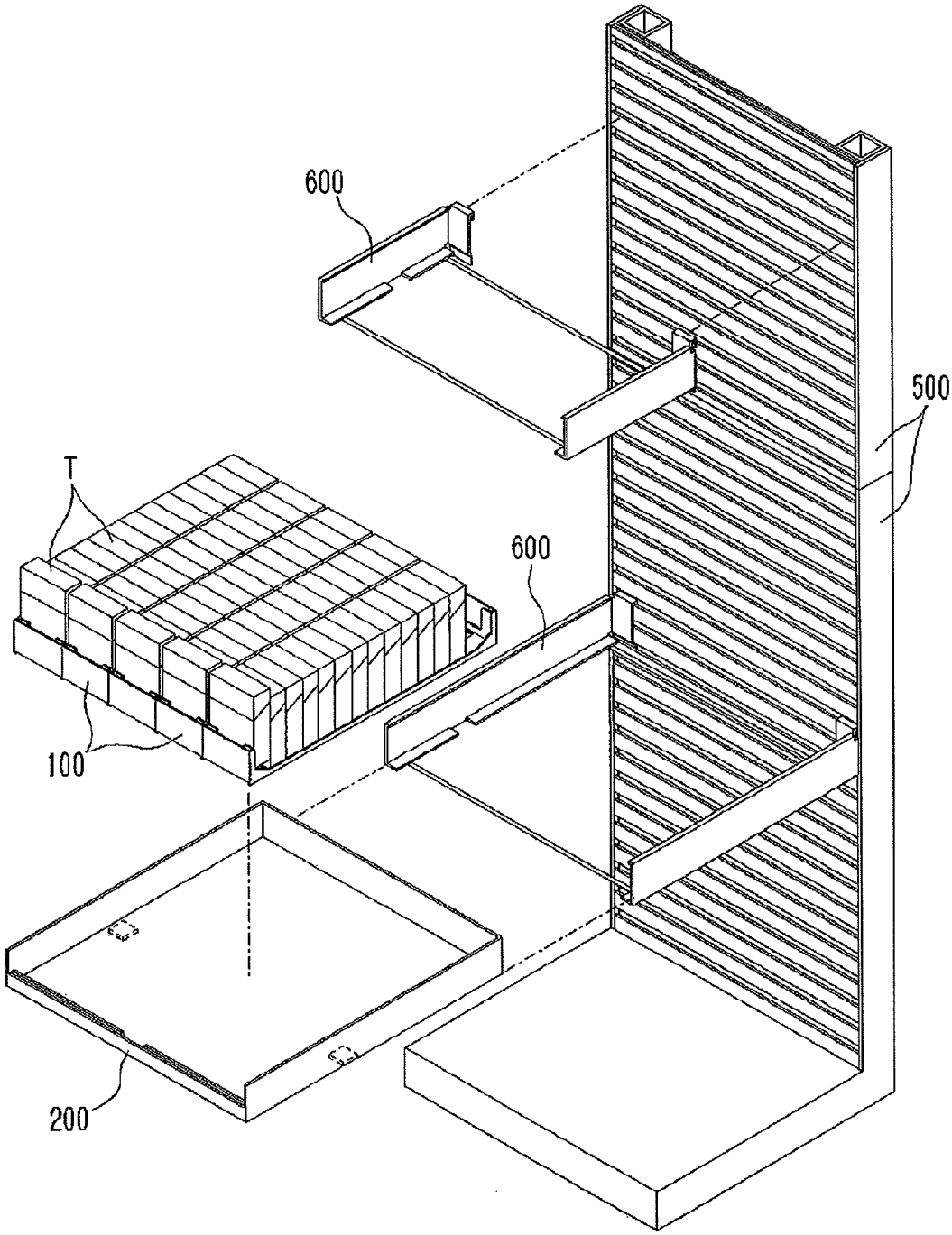
FIG. 26 is an exploded perspective view showing a condition in which a tray unit is being attached to a wall unit by a tray attachment.

As shown in FIGS. 24 and 25, tray attachments 600*a* to 600*d* are formed in a structure capable of holding the tray units 200*a* to 200*d* respectively. More specifically, the tray attachment 600 has support frames 610 having the same structure as that of the support frame 320 of the frame unit 300.

The pair of support frames 610 is linked by link frames 620 at the front and back of the bottom surface. And, the engagement mechanism 630 which detachably engages with the concave channel 511 of the wall unit 500 is formed at the back end of the support frame 610. Because of this, the wall unit 500 is formed to have a lateral width which corresponds to the wide tray attachments 600*a* and 600*c*.

The cigarette display system 1000 may have a desired height by linking a plurality of wall units 500 in the vertical direction. And, it is also possible to have a desired lateral width by arranging the wall units 500 in the lateral direction.

And, the tray attachment 600 is attached to a desired position of the front surface of the wall units 500 arranged in the vertical and lateral directions as mentioned above, so that the tray unit 200 can be held by the tray attachment 600. In the tray unit 200, the cigarette cartons K can be directly accommodated, and also the cigarette packs T can be accommodated by using the magazine units 100.

Figure 27:
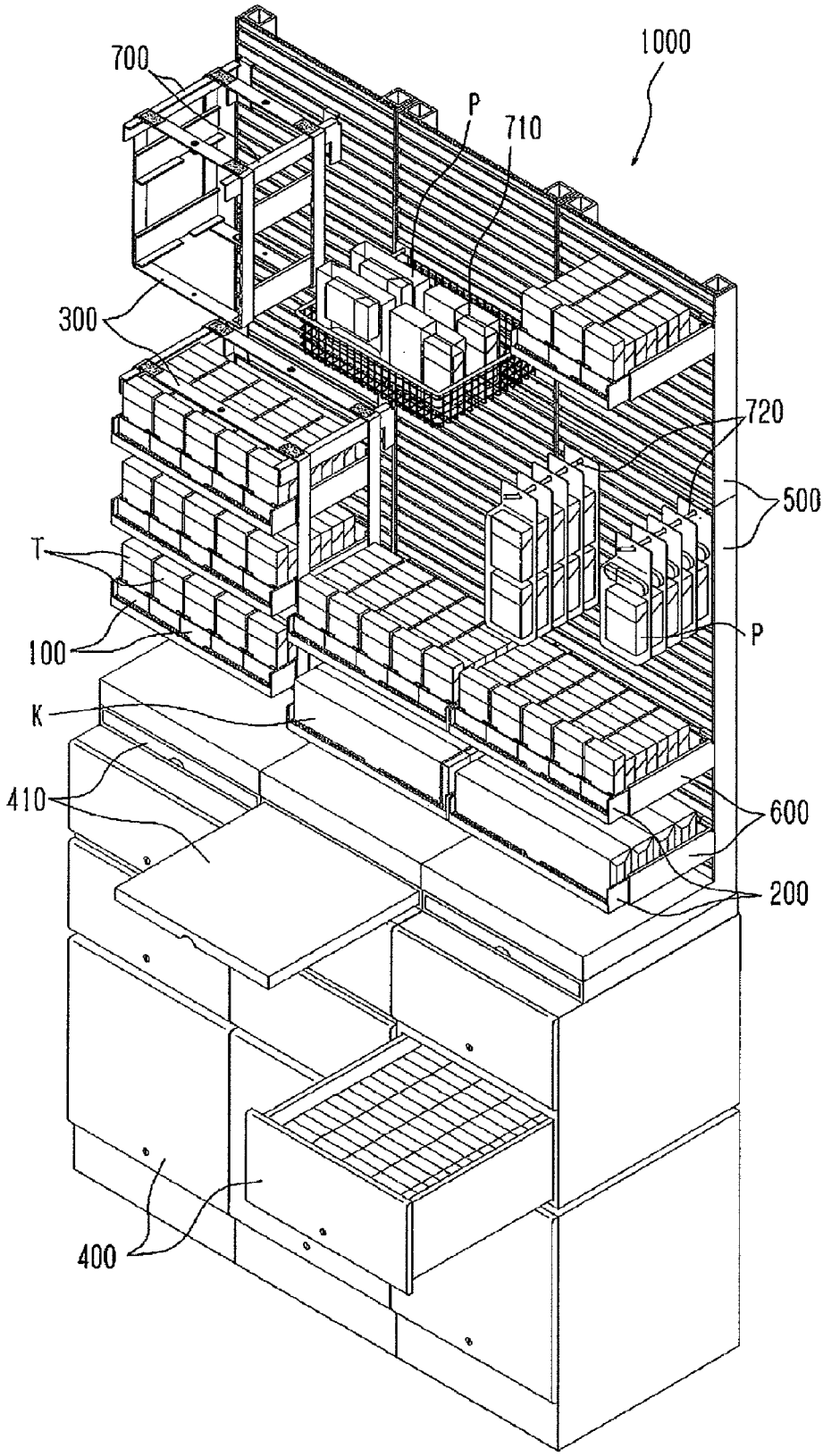
FIG. 27 is a perspective view showing an appearance of another modification of the cigarette display system having stocker units by using the wall units.

Furthermore, as shown in FIG. 27, the wall units 500 arranged in the vertical and lateral directions as mentioned above can be placed on a top surface of the stocker units 400 arranged in the vertical and lateral directions. In addition, it is possible to set up the cigarette display system 1000 (not shown) by juxtaposing a system set up by the wall units 500 and a system set up by the frame units 300.

In the above mentioned cigarette display system 1000, the wall units 500 and the frame units 300 forming the whole system commonly use the tray units 200 and the magazine units 100. Therefore, a manufacturer which produces the cigarette display system 1000 can increase its productivity.

Furthermore, in a store where the cigarette display system 1000 is used, the tray units 200 and magazine units 100 can be continuously used, even when the use of the frame units 300 is changed to the use of the wall units 500.

And, when the cigarette display system 1000 which is set up by the frame units 300 are used in some of a plurality of sales spaces and the cigarette display system 1000 which is set up by the wall units 500 are used in the other sales spaces, the tray units 200 and the magazine units 100 can be commonly used by both of the cigarette display systems 1000.

Figure 28:
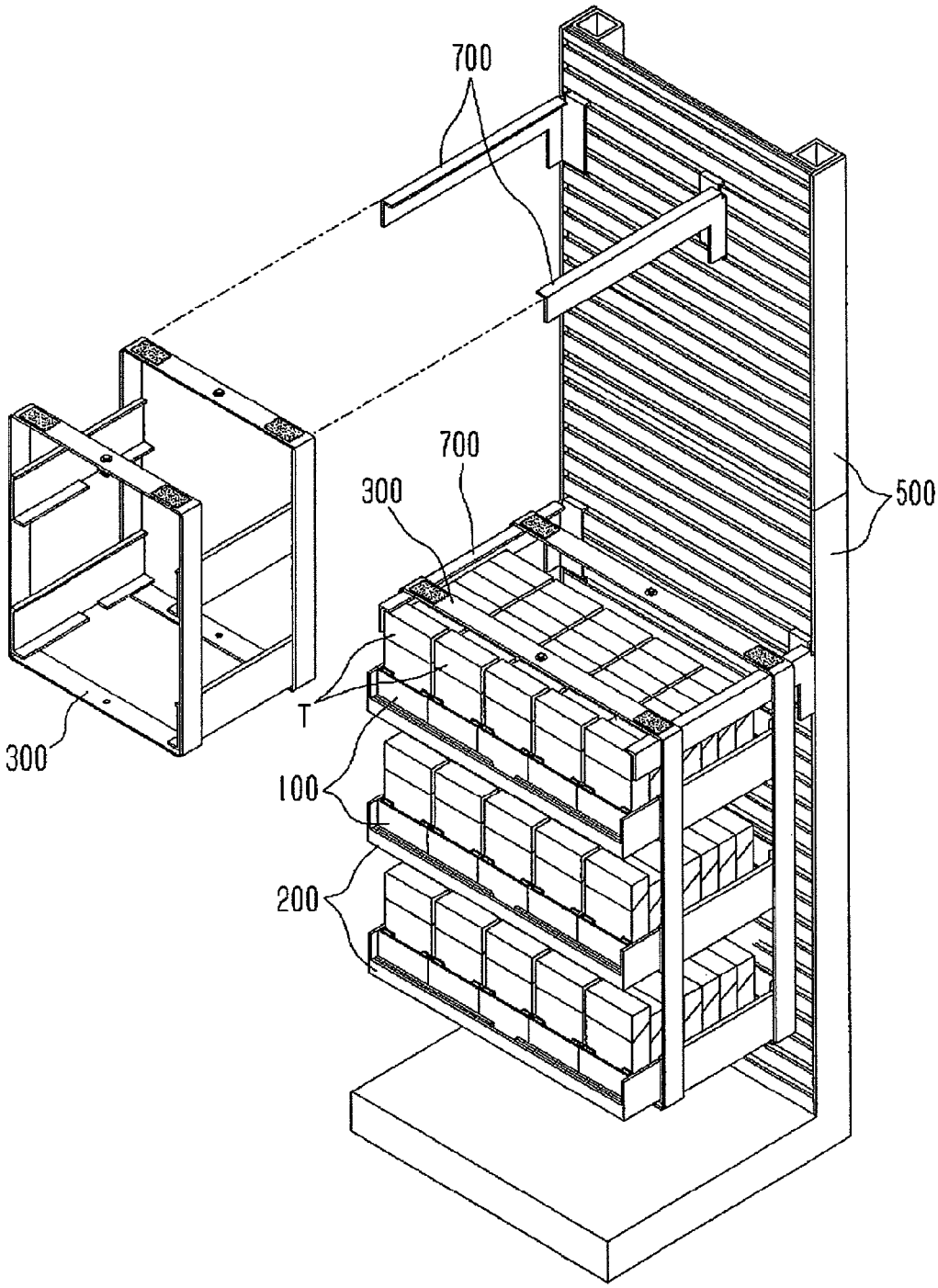
FIG. 28 is an exploded perspective view showing a condition of another modification in which a frame unit is being attached to the wall unit by a frame attachment.

Various units can be attached to the wall units 500 as mentioned above. For example, as shown in FIG. 28, the frame unit 300 can be attached to the front surface of the wall units 500 by frame attachments 700.

Figure 29:
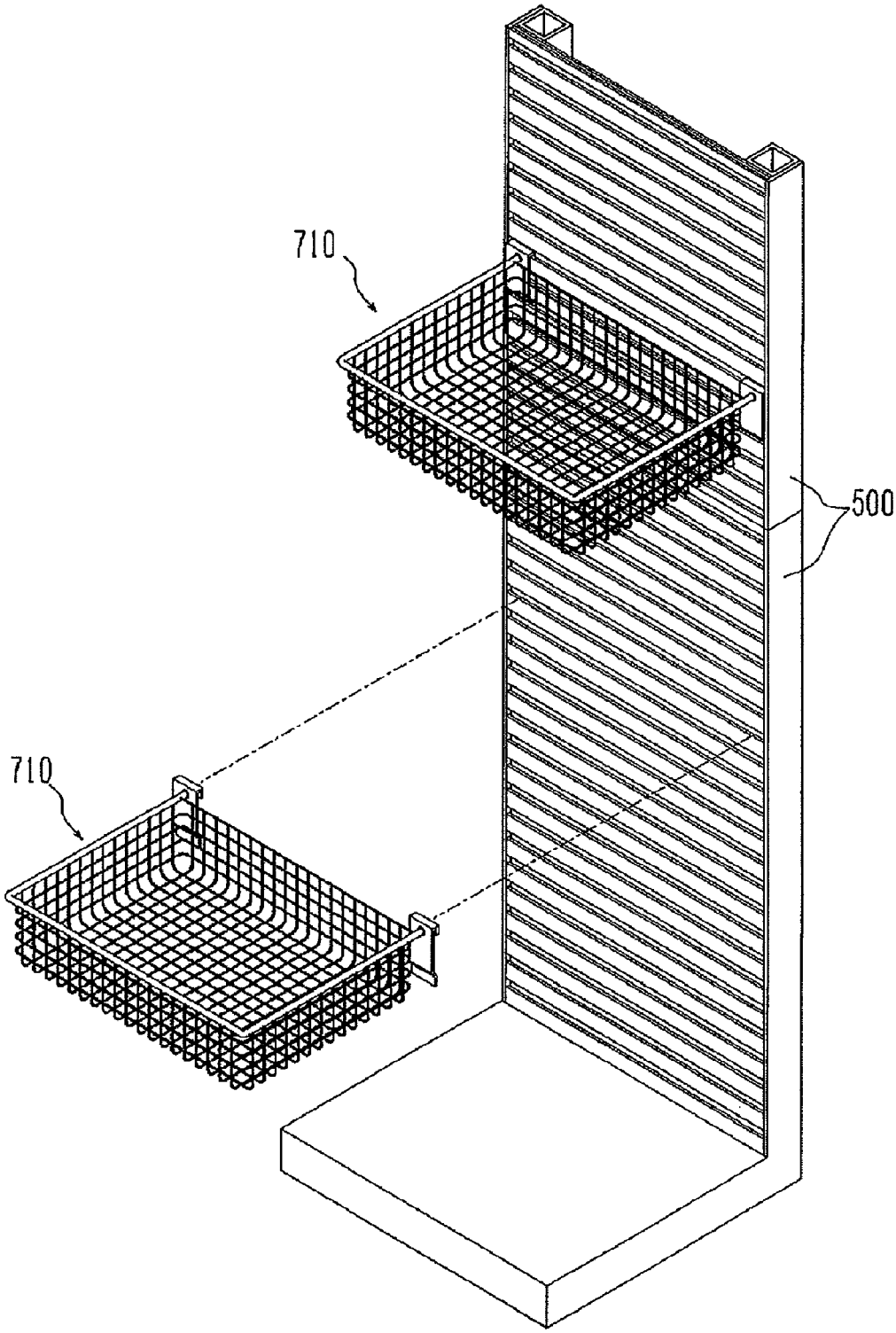
FIG. 29 is an exploded perspective view showing a condition of another modification in which a basket unit is being attached to the wall unit.

And, as shown in FIG. 29, it is also possible to attach a basket unit 710 formed in the shape of a box with an opened top to the front surface of the wall units 500, and accommodate the cigarette cartons K or the like in the basket unit 710.

Figure 30:
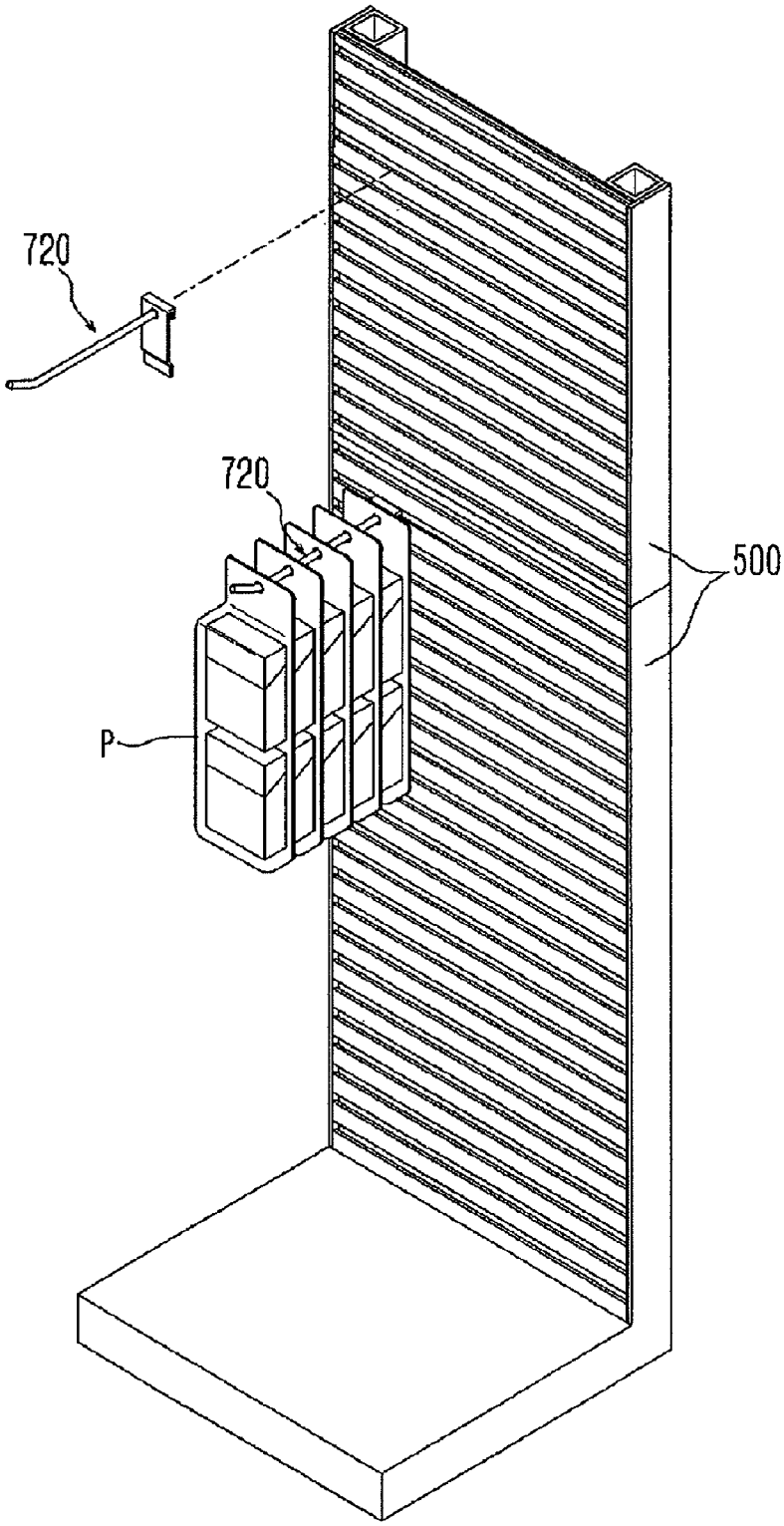
FIG. 30 is an exploded perspective view showing a condition of another modification in which a shaft unit is being attached to the wall unit.

Furthermore, as shown in FIG. 30, it is also possible to attach a shaft unit 720 elongated in a direction from front to back to the front surface of the wall units 500, and suspend the campaign pack P, cigarette pack T and the like on the shaft unit 720.

At present, when the cigarette pack T displayed in the cigarette display system 1000 is sold, the sales information is collected by an electronic cash register (not shown).

Further, when the cigarette packs T or the like are replenished in the cigarette display system 1000, the replenishment information and inventory information are collected by a handy terminal (not shown) or the like.

However, it is also possible to provide function for collecting such sales information, replenishment information, and inventory information to the cigarette display system 1000. For example, at present, it is considered to mount an RFID (Radio Frequency Identification) chip (not shown) on various commodities such as the cigarette packs T.

Accordingly, installing an RFID reader (not shown) in the cigarette display system 1000 makes it possible to collect the sales information, the replenishment information, and the inventory information of the cigarette display system 1000.

For example, the RFID reader as mentioned above can be installed in the magazine unit 100, the tray unit 200, the frame unit 300, and the like, and also it may be a unit detachably attached to the magazine unit 100, the tray unit 200, the frame unit 300, and the like.

When providing the cigarette display system 1000 to a store, it is obvious that a combination of necessary units 100 to 500, and the like is different in each store. In that case, necessary units 100 to 500, and the like are considered at store side. And it is possible to provide a display simulator 800 to support the consideration to the store.

Figure 31:
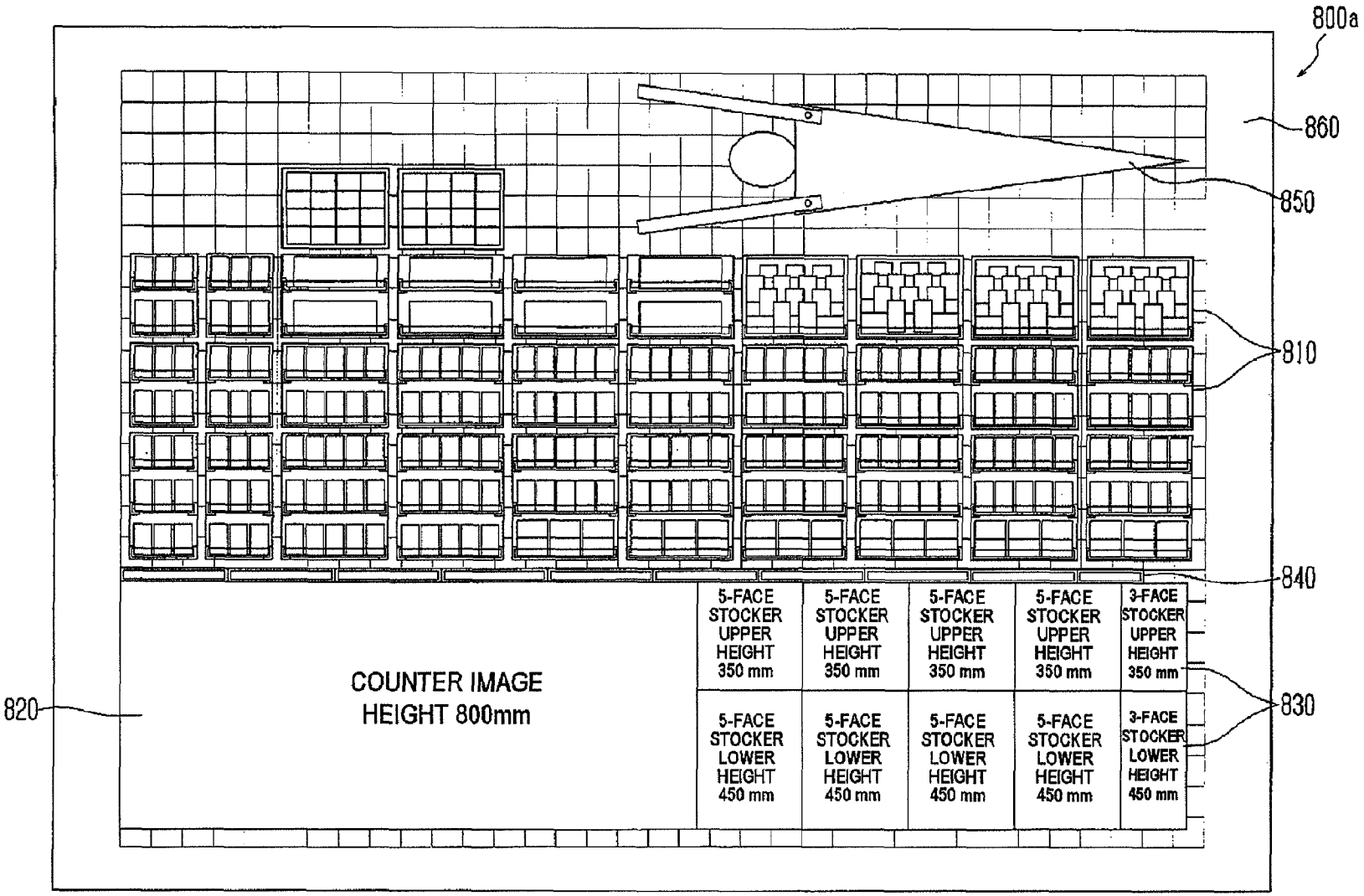
FIG. 31 is a plan view showing an appearance of a display simulator of another modification.

Such a display simulator 800*a* as shown in FIG. 31, includes: flat plate unit models 810 simulating the front surface shape of the frame units 300 on a predetermined scale; a counter model 820 simulating a front surface shape of a store counter (not shown) on the same scale as that of the unit models 810; stocker models 830 simulating the front surface shape of the stocker units 400 on the same scale; table models 840 simulating the front surface shape of the table units 410 on the same scale; a flat plate human model 850 simulating a front surface shape of a person on the same scale; and a layout board 860 on which the plurality of models 810 to 840 are laid out and detachably attached and at the same time the human model is detachably attached, for example.

Figure 32:
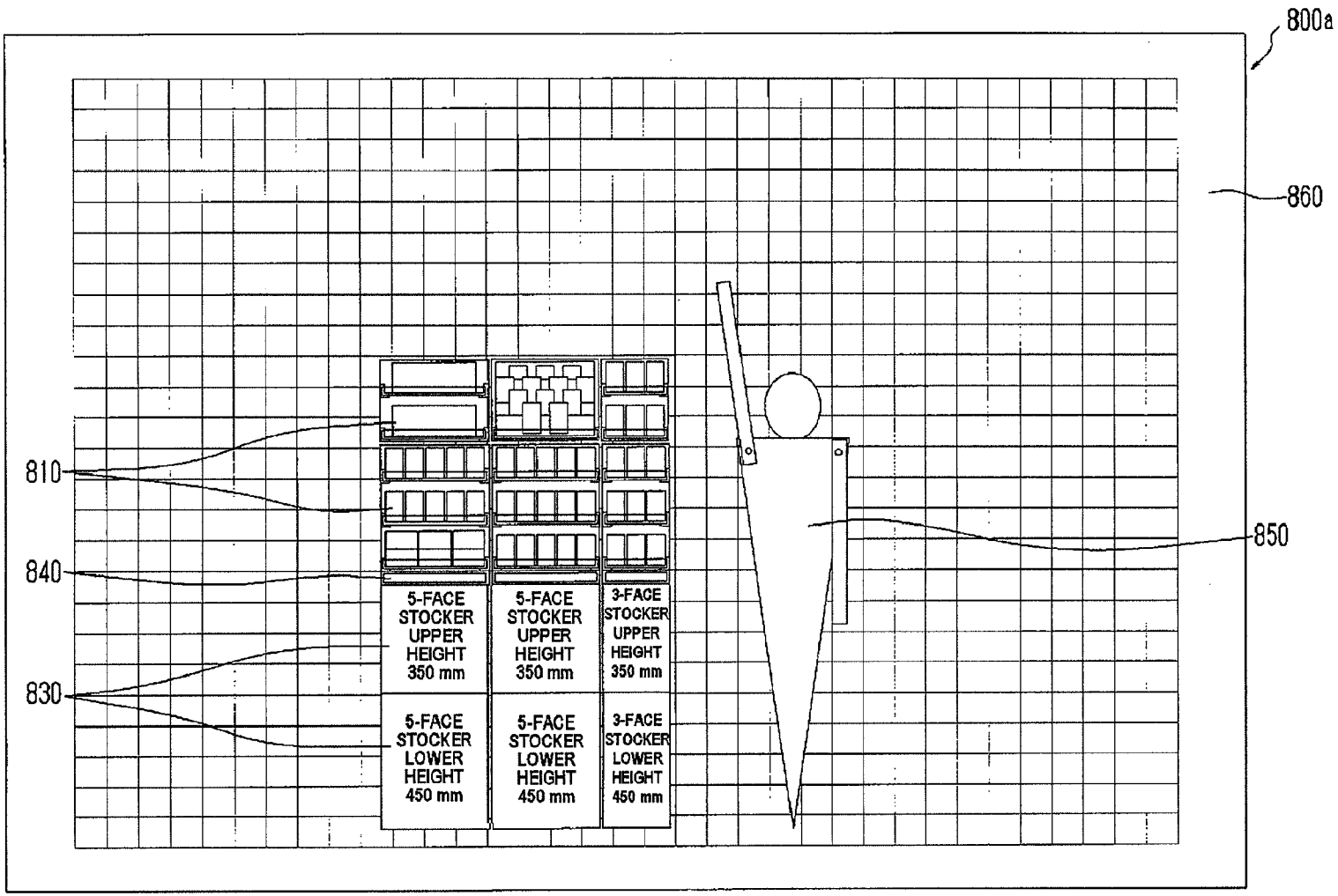
FIG. 32 is a plan view showing a condition in which the display simulator is used.

The layout board 860 is formed by a magnetic sheet and the models 810 to 850 are formed by a magnet sheet. In a store to which such a display simulator 800*a* is provided, by laying out various models 810 to 830 on the layout board 860, as shown in FIG. 32, it is possible to consider a combination of various units 100 to 500 and the like of the cigarette display system 1000.

In addition, since this display simulator 800*a* includes the human model 850 on a unified scale, it is possible to check a relative relationship between the cigarette display system 1000 and a person.

Especially, the human model 850 is formed so that an arm part is rotatable. Accordingly, it is possible to check whether the cigarette display system 1000 can be set up within an area in which a person operates.

Furthermore, it is possible that a manufacturer of the cigarette display system 1000 collects the display simulator 800*a* in which various models 810 to 830 are laid out on the layout board 860 in a store, and then provides various units 100 to 500 and the like to the store corresponding to the layout.

Figure 33:
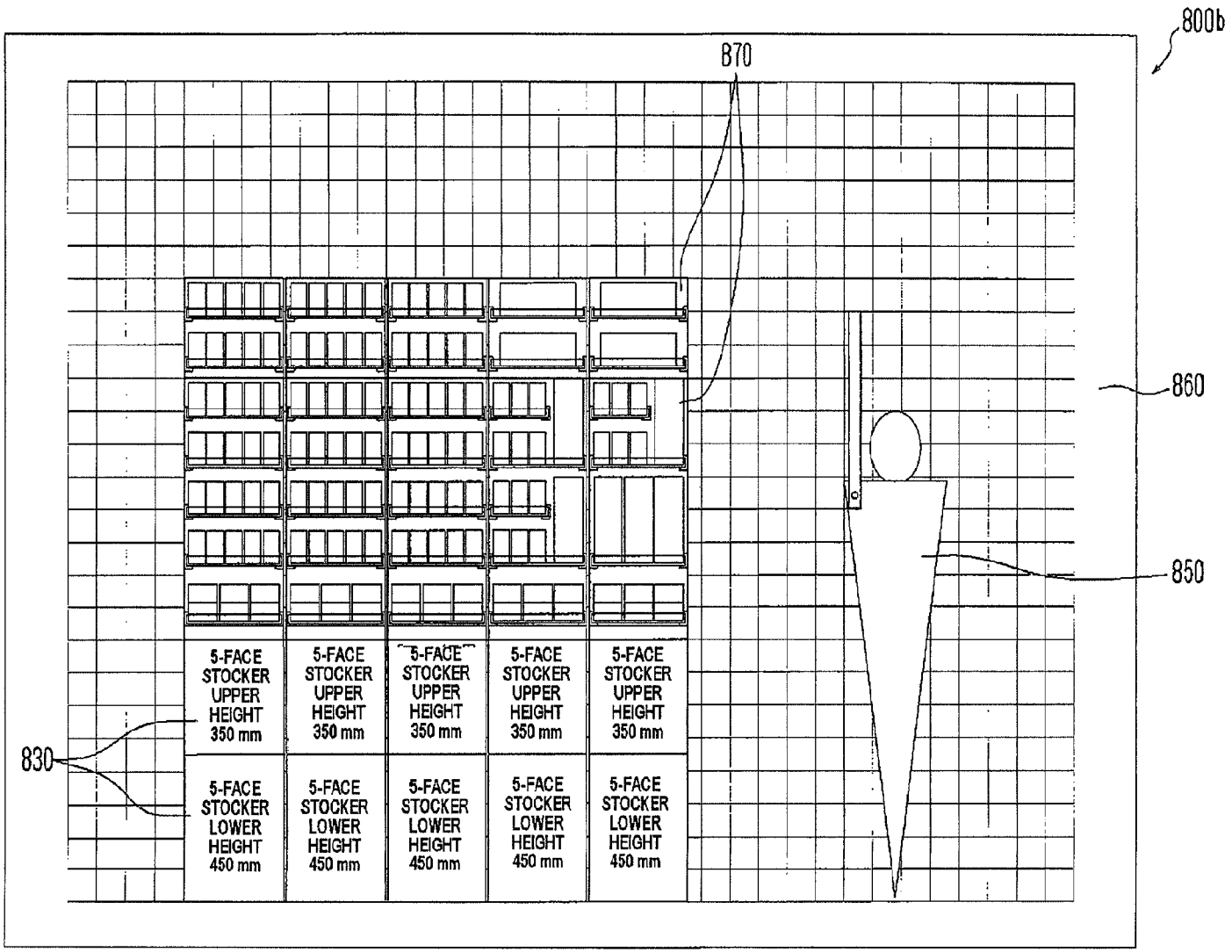
FIG. 33 is a plan view showing an appearance of a display simulator of another modification.

Of course, as shown in FIG. 33, it is possible, in the same way, to form a display simulator 800*b* including flat plate unit models 870 simulating the front surface shape of the frame units 500 on a predetermined scale.

The invention claimed is:

1. A cigarette display system for displaying cigarette packs to be sold, the system comprising:

a plurality of magazine units formed in the shape of a box which is elongated in a direction from front to back and having an opened top, said magazine units having a shape which allows a plurality of cigarette packs to be held therein while being arranged in the direction from front to back;

a plurality of tray units formed in the shape of a box having an opened top, said tray units having a shape which allows a plurality of said magazine units arranged in the lateral direction to be held detachably;

a plurality of frame units formed in the shape of a box having an opened front, said frame units having a shape which allows a plurality of said tray units to be held detachably while arranging said tray units vertically apart from each other; and a frame link mechanism for linking a plurality of said frame units in the vertical direction, wherein said frame unit includes:

a plurality of main frames made of a metal plate which is bent so that a front shape becomes rectangular, said main frames being arranged in a direction from front to back; and a plurality of support frames made of a metal plate which is formed in a rail shape elongated in a direction from front to back for supporting said tray unit, each pair of said support frames being arranged in the vertical direction and joined to an inner surface of said plurality of main frames.

2. The cigarette display system according to claim 1, wherein said magazine units include a plurality of types of magazine units whose lengths from front to back are different from one another corresponding to the number of said cigarette packs to be held, and said tray units include a plurality of types of tray units whose lengths from front to back are different from one another corresponding to said plurality of types of said magazine units.

3. The cigarette display system according to claim 1, wherein said tray units include a plurality of types of tray units whose lateral widths are different from one another corresponding to the number of said magazine units to be held, and said frame units include a plurality of types of frame units whose lateral widths are different from one another corresponding to said plurality of types of said tray units.

4. The cigarette display system according to claim 3, further comprising:

a plurality of wall units which is formed in a flat plate shape flattened in a direction from front to back and has a front surface on which recesses and protrusions of a predetermined shape are formed;

a wall link mechanism for linking a plurality of said wall units in the vertical direction; and a plurality of tray attachments, in each of which, an engagement mechanism for detachably engaging with said recesses and protrusions of said wall units is formed at a rear part, said tray attachments holding said tray units;

wherein said tray attachments include a plurality of types of tray attachments whose lateral widths are different from one another corresponding to said plurality of types of said tray units, and a lateral width of each of said wall units corresponds to a lateral width of at least one of said plurality of types of said tray attachments.

5. The cigarette display system according to claim 3, further comprising a stocker unit formed in the shape of a box which has at least a flat top surface and a front surface, which can be opened and closed, wherein said stocker unit includes a plurality of types of stocker units whose lateral widths of said top surface are different from one another corresponding to said plurality of types of said frame units.

6. The cigarette display system according to claim 1, wherein said frame units include a plurality of types of frame units whose heights are different from one another corresponding to the number of said tray units to be held.

7. The cigarette display system according to claim 1, further comprising:

a plurality of wall units which is formed in a flat plate shape flattened in a direction from front to back and has a front surface on which recesses and protrusions of a predetermined shape are formed;

a wall link mechanism for linking a plurality of said wall units in the vertical direction; and a plurality of tray attachments, in each of which, an engagement mechanism for detachably engaging with said recesses and protrusions of said wall units is formed at a rear part, said tray attachments holding said tray units.

8. The cigarette display system according to claim 1, wherein said frame link mechanism includes surface fasteners attached to a top surface and a bottom surface of said frame unit.

9. The cigarette display system according to claim 1, wherein at least a pair of concave frame sections is formed in said bottom surface of said frame unit, and at least a pair of frame protrusions for respectively engaging with said concave frame sections is formed on said top surface of said frame unit.

10. The cigarette display system according to claim 1, wherein said tray unit is provided with tray protrusions formed on both sides of a bottom surface thereof, and said frame unit is provided with guide concave parts formed in said support frame, said guide concave parts respectively engaging with said tray protrusions.

11. The cigarette display system according to claim 10, wherein when a plurality of said frame units are arranged in said lateral direction while alternately front-back inverted in such arrangement that said main frames are adjacent to each other in a direction from front to back, the positions of said guide concave parts of each frame unit in a direction from front to back are lined up in well-positioned.

12. The cigarette display system according to claim 11, further comprising a lateral link mechanism for holding said main frames of said frame units arranged in said lateral direction while alternately front-back inverted and, said main frames being adjacent to each other in a direction from front to back.

13. The cigarette display system according to claim 1, wherein said cigarette pack is formed in a rectangular solid shape, there is a rectangular solid shape cigarette carton including a packaged plurality of said cigarette packs, and said tray unit is formed in a shape in which said cigarette carton is arranged to elongate in said lateral direction.

14. The cigarette display system according to claim 1, wherein said magazine unit includes a slider member arranged on a bottom surface on which said cigarette packs are placed so as to be slidable in a direction from front to back, and an urging mechanism which resiliently urges said slider member forward, and said bottom surface is made in a flat plane without a protrusion at least in a range where sliding movement is allowed for said slider member.

15. The cigarette display system according to claim 1, further comprising a slider unit which is detachably attached to a bottom surface of said tray unit, wherein said slider unit includes:

a guide rail elongated in a direction from front to back, an attaching and removing mechanism which detachably attaches said guide rail to said bottom surface of said tray unit, a slider member which is supported by said guide rail so as to be slidable, and an urging mechanism which resiliently urges said slider member forward.

* * * * *